US010479093B2

(12) United States Patent
Suzuki et al.

(10) Patent No.: US 10,479,093 B2
(45) Date of Patent: Nov. 19, 2019

(54) INKJET PRINTER

(71) Applicant: Roland DG Corporation, Hamamatsu-shi, Shizuoka (JP)

(72) Inventors: Akihiro Suzuki, Hamamatsu (JP); Hirokazu Kakei, Hamamatsu (JP)

(73) Assignee: ROLAND DG CORPORATION, Shizuoka (JP)

( * ) Notice: Subject to any disclaimer, the term of this patent is extended or adjusted under 35 U.S.C. 154(b) by 0 days.

(21) Appl. No.: 16/228,912

(22) Filed: Dec. 21, 2018

(65) Prior Publication Data

US 2019/0193405 A1 Jun. 27, 2019

(30) Foreign Application Priority Data

Dec. 25, 2017 (JP) ..... 2017-247446
Dec. 25, 2017 (JP) ..... 2017-248409
Nov. 20, 2018 (JP) ..... 2018-217325

(51) Int. Cl.
*B41J 2/17* (2006.01)
*B41J 2/165* (2006.01)
*B41J 2/185* (2006.01)

(52) U.S. Cl.
CPC ..... *B41J 2/1721* (2013.01); *B41J 2/16579* (2013.01); *B41J 2/185* (2013.01); *B41J 2/1714* (2013.01); *B41J 2002/16502* (2013.01); *B41J 2002/1856* (2013.01)

(58) Field of Classification Search
CPC ..... B41J 2/1721; B41J 2/16579; B41J 2/185; B41J 2002/16502; B41J 2002/1856; B41J 2002/16582; B41J 2/1714
See application file for complete search history.

(56) References Cited

U.S. PATENT DOCUMENTS 7,419,241 B2 * 9/2008 Kawashima ..... B41J 2/1721 347/35
7,621,619 B2 * 11/2009 Sakakitani ..... B41J 2/16511 347/36
2003/0142150 A1 7/2003 Barton et al.
2010/0020128 A1 1/2010 Kubo
2014/0292892 A1 10/2014 Dan

FOREIGN PATENT DOCUMENTS

JP 11-334110 A 12/1999
JP 2002-029065 A 1/2002
JP 2010-030087 A 2/2010
JP 2013-067123 A 4/2013
JP 2014-166684 A 9/2014
JP 2014-195974 A 10/2014

* cited by examiner

*Primary Examiner* — Thinh H Nguyen
(74) *Attorney, Agent, or Firm* — Keating & Bennett, LLP

(57) ABSTRACT

A printer includes a head that injects a liquid, a cleaning mechanism, a waste liquid path, a waste liquid tank that is detachably attached and collects waste liquid, a displaceable member that is displaced to a first position when the waste liquid tank is attached and is displaced to a second position when the waste liquid tank is detached, a liquid receiving portion that is provided on the displaceable member and is located directly below an outlet of the waste liquid path when the waste liquid tank is not attached, a detection target that is provided on the displaceable member and moves together with the displaceable member, and a sensor that detects the detection target.

12 Claims, 19 Drawing Sheets

INKJET PRINTER

CROSS REFERENCE TO RELATED APPLICATIONS

This application claims the benefit of priority to Japanese Patent Application No. 2017-247446 filed on Dec. 25, 2017, Japanese Patent Application No. 2017-248409 filed on Dec. 25, 2017 and Japanese Patent Application No. 2018-217325 filed on Nov. 20, 2018. The entire contents of these applications are hereby incorporated herein by reference.

BACKGROUND OF THE INVENTION

1. Field of the Invention

The present invention relates to an inkjet printer.

2. Description of the Related Art

Conventionally, an inkjet printer including an ink head injecting ink toward a printing target is known. In such an inkjet printer, a cleaning operation of discharging ink from a nozzle or absorbing the ink in the nozzle is periodically performed while printing is performed or while no printing is performed in order to guarantee that the ink is injected from the nozzle stably. This operation causes the ink having a higher viscosity in the nozzle to be discharged, and thus solves or alleviates the problem of the nozzle being clogged. As a result of the cleaning operation, waste ink not usable for printing is discharged.

Prior art documents relating to an inkjet printer performing such a cleaning operation include Japanese Laid-Open Patent Publication No. H11-334110 and Japanese Laid-Open Patent Publication No. 2002-29065. For example, Japanese Laid-Open Patent Publication No. H11-334110 discloses an inkjet printer including an ink absorbing mechanism that cleans an ink head, a waste ink tank that accommodates ink absorbed by the ink absorbing mechanism, a waste ink flow path that guides the ink from the ink absorbing mechanism to the waste ink tank, a waste ink receiver that is located between the waste ink flow path and the waste ink tank and receives and temporarily stores the waste ink, and a waste ink tank sensor that senses whether or not the waste ink tank is at a set position at which the waste ink tank receives the ink from the waste ink flow path.

SUMMARY OF THE INVENTION

In the inkjet printer disclosed in Japanese Laid-Open Patent Publication No. H11-334110, the waste ink tank sensor and the waste ink receiver are separate from each other and have independent structures. Therefore, a controller of the inkjet printer first checks whether or not the waste ink tank is at the above-mentioned set position based on an output from the waste ink tank sensor, and when determining that the waste ink tank is not at the set position, controls a waste ink receiver driving motor such that the waste ink receiver is moved to the set position. This structure prevents the inside of the inkjet printer or a floor surface from being stained due to the waste ink dripping from the waste ink flow path while the waste ink tank is attached or detached. However, such a conventional inkjet printer has a problem that the structure of components in the vicinity of the waste ink tank is complicated and the number of the components and the number of steps of assembling the components are significantly increased. This also causes a problem of increasing the production cost.

SUMMARY OF THE INVENTION

Preferred embodiments of the present invention provide inkjet printers that each prevent the inside thereof or a floor surface from being stained with waste liquid while a waste liquid tank is attached or detached and is simplified in the structure of components in the vicinity the of a waste liquid tank.

In a preferred embodiment according to the present invention, an inkjet printer includes a device main body; a head including a nozzle that injects a liquid; a cleaning mechanism that performs an operation of causing the liquid to be discharged from the nozzle; a waste liquid path including an inlet into which the liquid discharged by the cleaning mechanism flows and an outlet from which the liquid is discharged; a waste liquid tank that is detachably attached to the device main body and collects the liquid discharged from the outlet of the waste liquid path; a displaceable member that is movably provided in the device main body, and is displaced to a first position when the waste liquid tank is attached to the device main body and is displaced to a second position when the waste liquid tank is detached from the device main body; a liquid receiving portion that is provided on the displaceable member so as to move together with the displaceable member, and is located at a position directly below the outlet when the displaceable member is at the second position; a detection target that is provided on the displaceable member so as to move together with the displaceable member, and is displaced to a first detection position when the displaceable member moves to the first position and is displaced to a second detection position when the displaceable member moves to the second position; a sensor that detects the position of the detection target; and a controller that determines that the waste liquid tank is attached to the device main body when the detection target is at the first detection position and determines that the waste liquid tank is not attached to the device main body when the detection target is at the second detection position, based on a detection result of the sensor.

In the above-described inkjet printer, the liquid receiving portion and the detection target are both provided in the displaceable member and integrally formed with each other. This simplifies the structure of components in the vicinity of the waste liquid tank and thus decreases the number of the components and the number of steps of assembling the components. The production cost is also decreased. Simple control is made possible, and thus the load on the controller is alleviated.

The above-described preferred embodiment of the present invention provides an inkjet printer that prevents the inside thereof or a floor surface from being stained with waste liquid while a waste liquid tank is attached or detached and is simplified in the structure of components in the vicinity of a waste liquid tank.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of inkjet printers (hereinafter, referred to simply as "printers") according to the present invention will be described with reference to the drawings. The preferred embodiments described herein are not intended to specifically limit the present invention, needless to say. Components and portions that have the same functions will bear the same reference signs, and overlapping descriptions will be omitted or simplified. In this specification, the term "inkjet printer" encompasses any printer using any of various printing methods of conventionally known inkjet technologies, for example, any of various continuous methods including a binary deflection method, a continuous deflection method and the like, or any of various on-demand methods including a thermal method, a piezoelectric element method and the like.

Preferred Embodiment 1

Figure 1:
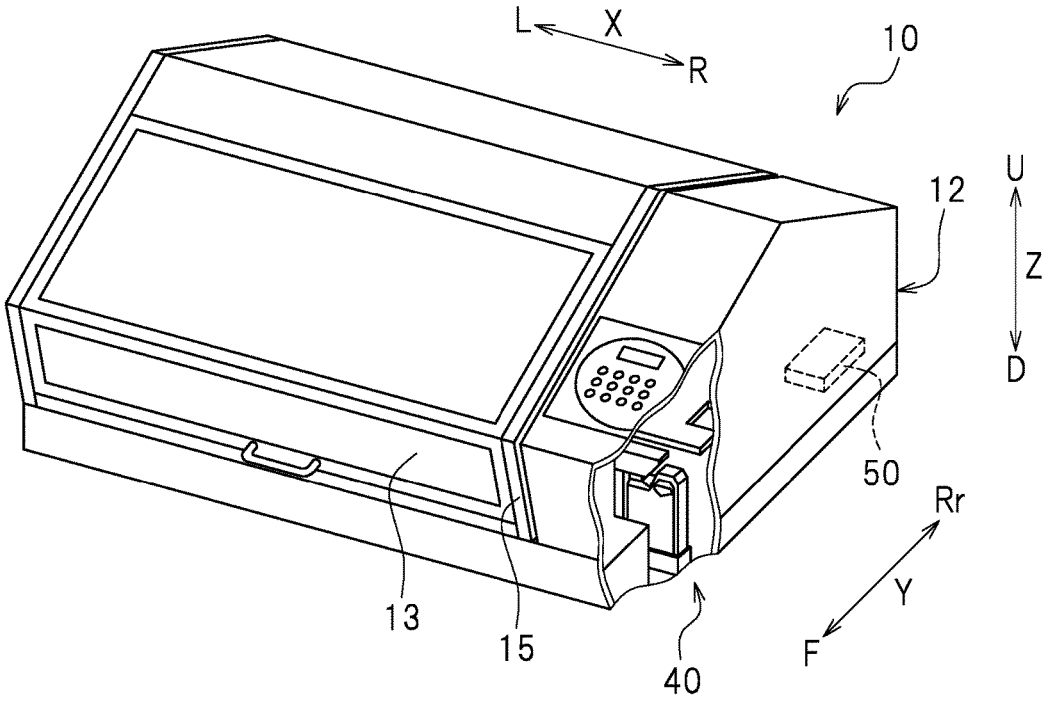
FIG. 1 is a perspective view of an inkjet printer in preferred embodiment 1 according to the present invention with a right portion thereof being partially cut out.
Figure 2:
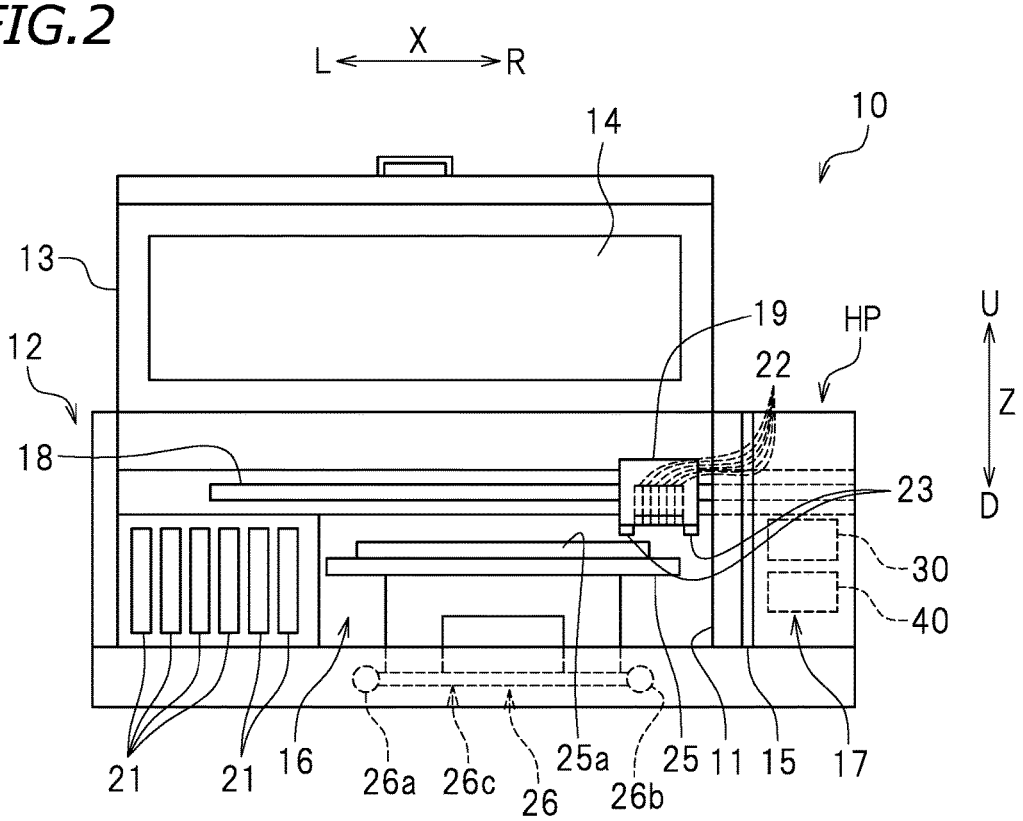
FIG. 2 is a front view of the inkjet printer in preferred embodiment 1 according to the present invention.

FIG. 1 is a perspective view of a printer 10 with a right portion thereof being partially cut out. FIG. 2 is a front view of the printer 10 in a state where a front cover 13 is opened. In the following description, terms "left", "right", "up" and "down" represent left, right, up and down as seen from a user facing a front surface of the printer 10. A direction approaching the user from the printer 10 is referred to as "forward", and a direction distanced farther from the user toward the printer 10 is referred to as "rearward". In the drawings, letters F, Rr, L, R, U and D respectively represent front, rear, left, right, up and down. In the drawings, letters X, Y and Z respectively represent a left-right direction, a front-rear direction and an up-down direction. These directions are provided merely for the sake of convenience, and do not limit the manner of installation of the printer 10.

The printer 10 uses photocurable ink. The printer 10 includes a casing 12 including an opening 11 and also includes a front cover 13 openable and also closable to cover the opening 11. The front cover 13 is supported by the casing 12 so as to be pivotable about a rear end thereof acting as an axis. The front cover 13 may be opened upward about the rear end thereof acting as an axis, so that an inner space of the casing 12 and a space outer to the casing 12 communicate with each other. The casing 12 is an example of a device main body. The inner space of the casing 12 is divided by a partition member 15 extending in the up-down direction Z into a first area 16 and a second area 17 located in series in the left-right direction X. The first area 16 is located to the left of the partition member 15. Printing on a printing target 25*a* is performed in the first area 16. The second area 17 is located to the right of the partition member 15. A cleaning mechanism 30 and a waste ink mechanism 40 are located in a front portion of the second area 17. A controller 50 is located in a rear portion of the second area 17.

A guide rail 18 is located above the casing 12. The guide rail 18 is secured to the casing 12, and extends in the left-right direction X across the first area 16 and the second area 17. A carriage 19 is slidably provided on the guide rail 18. The carriage 19 is reciprocally movable by a carriage moving mechanism (not shown) in the left-right direction X along the guide rail 18. The carriage moving mechanism includes a pair of pulleys (not shown) located at a right end and a left end of the guide rail 18, an endless belt (not shown), and a carriage motor (not shown). The carriage 19 is secured to the endless belt wound along the pair of pulleys. One of the pulleys is coupled with the carriage motor. The carriage motor is electrically connected with the controller 50, and is controlled by the controller 50. When the carriage motor is driven, the pulleys are rotated to run the endless belt. As a result, the carriage 19 moves in the left-right direction X along the guide rail 18.

The carriage 19 preferably includes six ink heads 22 and two ultraviolet lamps 23 mounted thereon, for example. The ink heads 22 each include a nozzle 22*a* (see FIG. 3) opened downward. The ink heads 22 are each structured to inject ink from the nozzle 22*a* toward the printing target 25*a*. In preferred embodiment 1, the six ink heads 22 are located in an in-line arrangement. The six ink heads 22 are located in series in the left-right direction X. The six ink heads 22 are respectively in communication with six ink cartridges 21 via flexible ink tubes (not shown).

The printer 10 includes the six ink cartridges 21 described above respectively in communication with the six ink heads 22. The six ink cartridges 21 each store ultraviolet-curable ink (UV ink). The UV ink typically contains a polymerizable compound and a polymerization initiator. The UV ink is ultraviolet-curable, and therefore, is less easily removed than, for example, aqueous ink or eco-solvent-based ink, once being attached to the printer 10, a floor surface or the like. Therefore, it is effective to adopt the technology disclosed herein. The six ink cartridges 21 respectively store cyan ink (C), magenta ink (M), yellow ink (Y), black ink (K), white ink (WH) and gloss ink (GL). In preferred embodiment 1, there are preferably six ink cartridges 21, for example. The number of the ink cartridges 21 may be, for example, five or smaller, or seven or larger. The ink cartridges 21 do not need to store the white ink and/or the gloss ink.

The two ultraviolet lamps 23 are structured to direct ultraviolet rays, usable to cure the ink, toward the printing target 25*a*. One of the two ultraviolet lamps 23 is located to the left of the six ink heads 22, and the other ultraviolet lamp 23 is located to the right of the six ink heads 22. The two ultraviolet lamps 23 are located in series with the ink heads 22 in the left-right direction X. Light directed by the ultraviolet lamps 23 has an ultraviolet wavelength with which the ink is curable. The ultraviolet lamps 23 are, for example, LEDs (Light Emitting Diodes), fluorescent lamps (low pressure mercury lamps), high pressure mercury lamps, or the like. In preferred embodiment 1, there are two ultraviolet lamps 23. The number of the ultraviolet lamps 23 may be one, or three or larger. The ultraviolet lamps 23 may be located only to the left of the ink heads 22 or only to the right of the ink heads 22. The ultraviolet lamps 23 may be mounted on, for example, a carriage different from the carriage 19 having the ink heads 22 mounted thereon. Alternatively, the ultraviolet lamps 23 may be provided directly or indirectly on, for example, a wall of the casing 12.

The printer 10 is a so-called flatbed printer. A table 25 is located below the carriage 19. On the table 25, the printing target 25*a* is placed. The printing target 25*a* may be formed of paper such as plain paper, inkjet printing paper or the like; a resin such as poly(vinyl chloride), acrylic resin, polycarbonate, polystyrene, acrylonitrile-butadiene-styrene (ABS) copolymer or the like; a metal material such as aluminum, stainless steel or the like; carbon; a ceramic material; glass; rubber; leather; or the like.

The table 25 is movable in the front-rear direction Y by a table moving mechanism 26. The table moving mechanism 26 is structured to move the table 25 in the front-rear direction Y with respect to the ink heads 22. The table moving mechanism 26 includes two slide rails 26*a* and 26*b*, a transfer member 26*c*, and a front-rear moving motor (not shown). The two slide rails 26*a* and 26*b* extend parallel or substantially parallel to each other in the front-rear direction Y. The transfer member 26*c* is slidable along the slide rails 26*a* and 26*b*. The table 25 is supported above the transfer member 26*c*. The front-rear moving motor is electrically connected with the controller 50, and is controlled by the controller 50. When the front-rear moving motor is driven, the transfer member 26*c* moves along the slide rails 26*a* and 26*b*. As a result, the table 25 moves in the front-rear direction Y.

Figure 3:
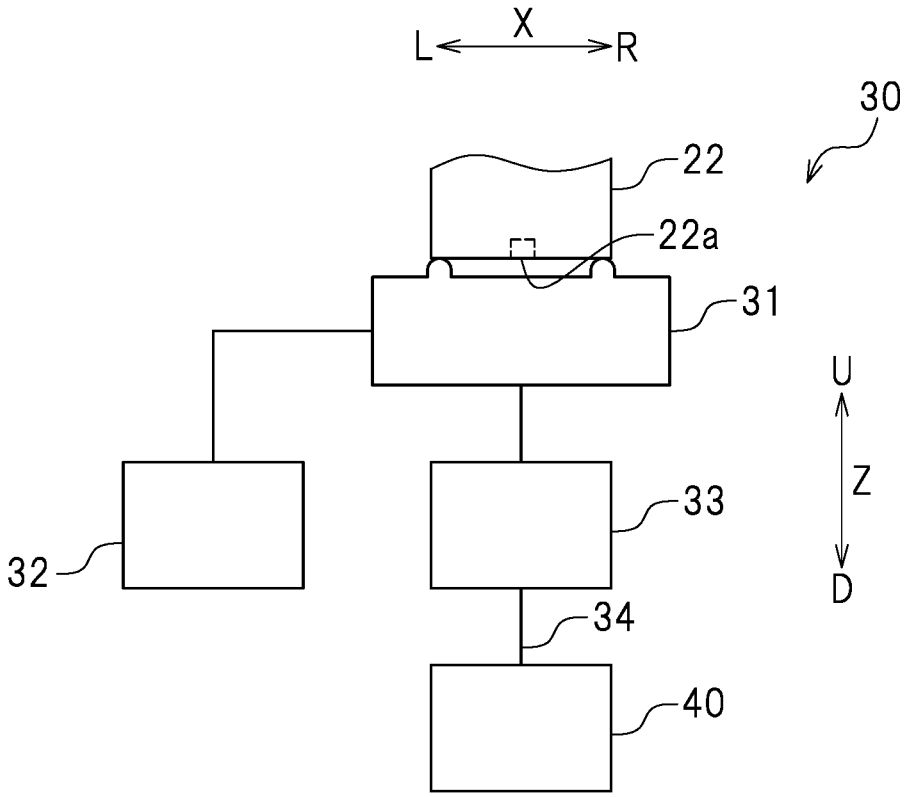
FIG. 3 is a schematic view of a cleaning mechanism in preferred embodiment 1 according to the present invention.

FIG. 3 is a schematic view showing an example of a cleaning mechanism 30. For example, dust may be attached to the nozzle 22*a* of any one of the ink heads 22, or the ink may be cured or made more viscous as a result of an ink solvent being evaporated. When such a situation occurs, the ink is not properly injected from the nozzle 22*a*, which causes a printing fault. For this reason, the cleaning mechanism 30 is structured to remove a foreign substance attached to the nozzle 22*a* (e.g., dust, cured ink, etc.).

The cleaning mechanism 30 is located below a home position HP (see FIG. 2) of the carriage 19. The cleaning mechanism 30 includes caps 31, cap moving mechanisms 32 and suction pumps 33. The caps 31 are each provided to cover the corresponding nozzle 22*a* at a bottom surface of the ink head 22. With such a structure, a closed space is defined between the nozzle 22*a* and the cap 31. The number of the caps 31 is typically equal to the number of the ink heads 22. In this example, the number of the caps 31 is six. The cap moving mechanisms 32 support the caps 31 and move the caps 31 in the up-down direction Z. The cap moving mechanisms 32 each include, for example, a cap moving motor (not shown). The cap moving motor is electrically connected with the controller 50, and is controlled by the controller 50. With such a structure, the caps 31 are each movable between a cap position, at which the cap 31 covers the corresponding nozzle 22*a*, and an isolated position, at which the cap 31 is isolated from the nozzle 22*a*. FIG. 3 shows a state where the cap 31 is at the cap position, namely, the cap 31 is attached to the nozzle 22*a*.

While no printing is performed, for example, while the printer 10 is at a stop, the carriage 19 waits at the home position HP. In this state, the cap 31 is located at the cap position by the cap moving mechanism 32. Therefore, the nozzle 22*a* of the ink head 22 is covered with the cap 31, and thus the ink is prevented from being dried in the nozzle 22*a*.

The suction pumps 33 each absorb the ink in the nozzle 22*a*. The suction pumps 33 are electrically connected with the controller 50, and are controlled by the controller 50. Waste ink paths 34 (first waste ink paths) are each a first waste ink flow path that guides waste ink from the cap 31 to the waste ink mechanism 40. The waste ink paths 34 are, for example, flexible ink tubes. The number of the waste ink paths 34 is typically equal to the number of the ink heads 22. In this example, there are six waste ink paths 34. The suction pumps 33 are each located in the middle of the corresponding waste ink path 34.

When each of the suction pumps 33 is driven in a state where the nozzle 22*a* of the ink head 22 is covered with the cap 31, the ink in the nozzle 22*a* is absorbed via the cap 31. As a result, the waste ink not usable for printing is discharged into the cap 31. When the ink head 22 is driven in a state where the nozzle 22*a* of the ink head 22 is covered with the cap 31, the ink is discharged in the cap 31. In other words, the waste ink not usable for printing (e.g., the ink in the nozzle 22*a*) is discharged into the cap 31. The cap 31 is in communication with the waste ink mechanism 40 via the waste ink path 34. The waste ink discharged into the cap 31 is sent to the waste ink mechanism 40 via the waste ink path 34.

Figure 4:
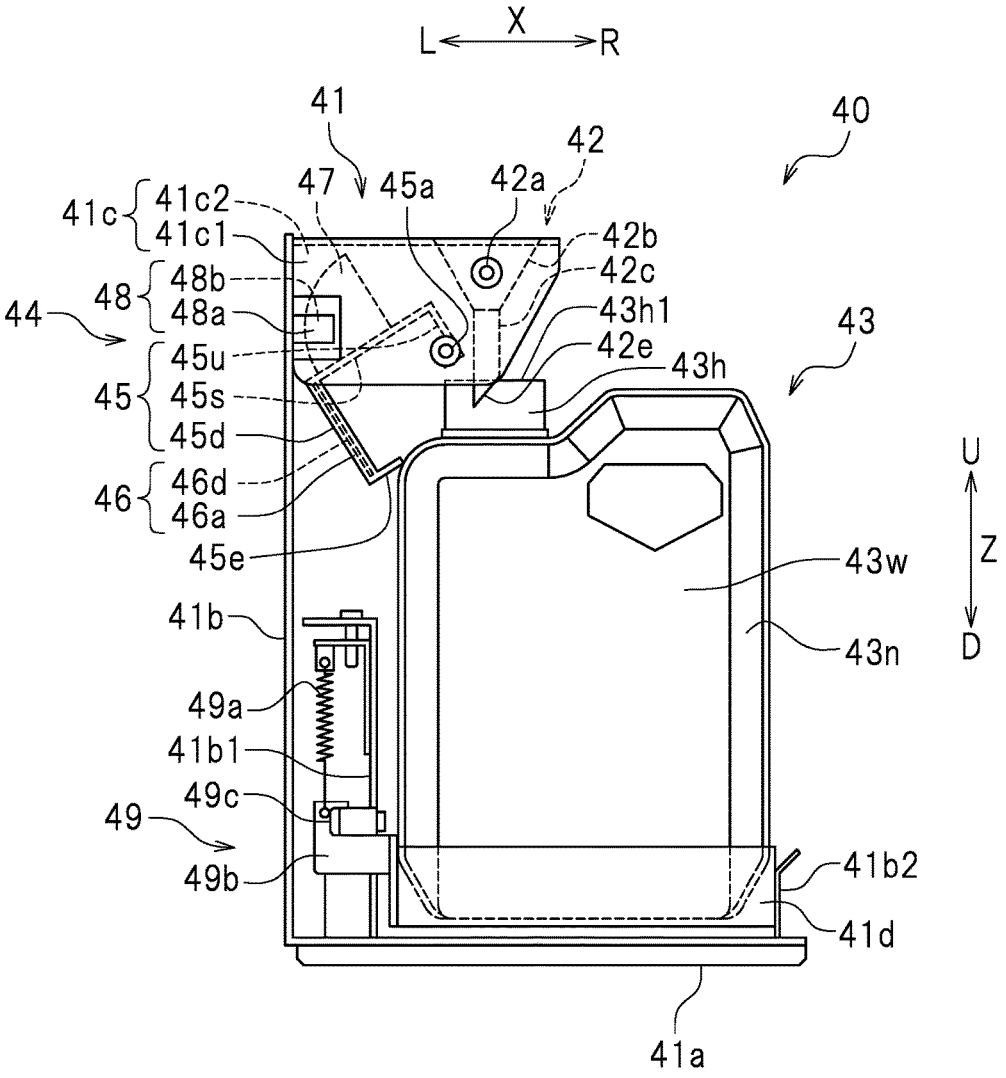
FIG. 4 is a side view of a waste ink mechanism in preferred embodiment 1 according to the present invention.
Figure 5:
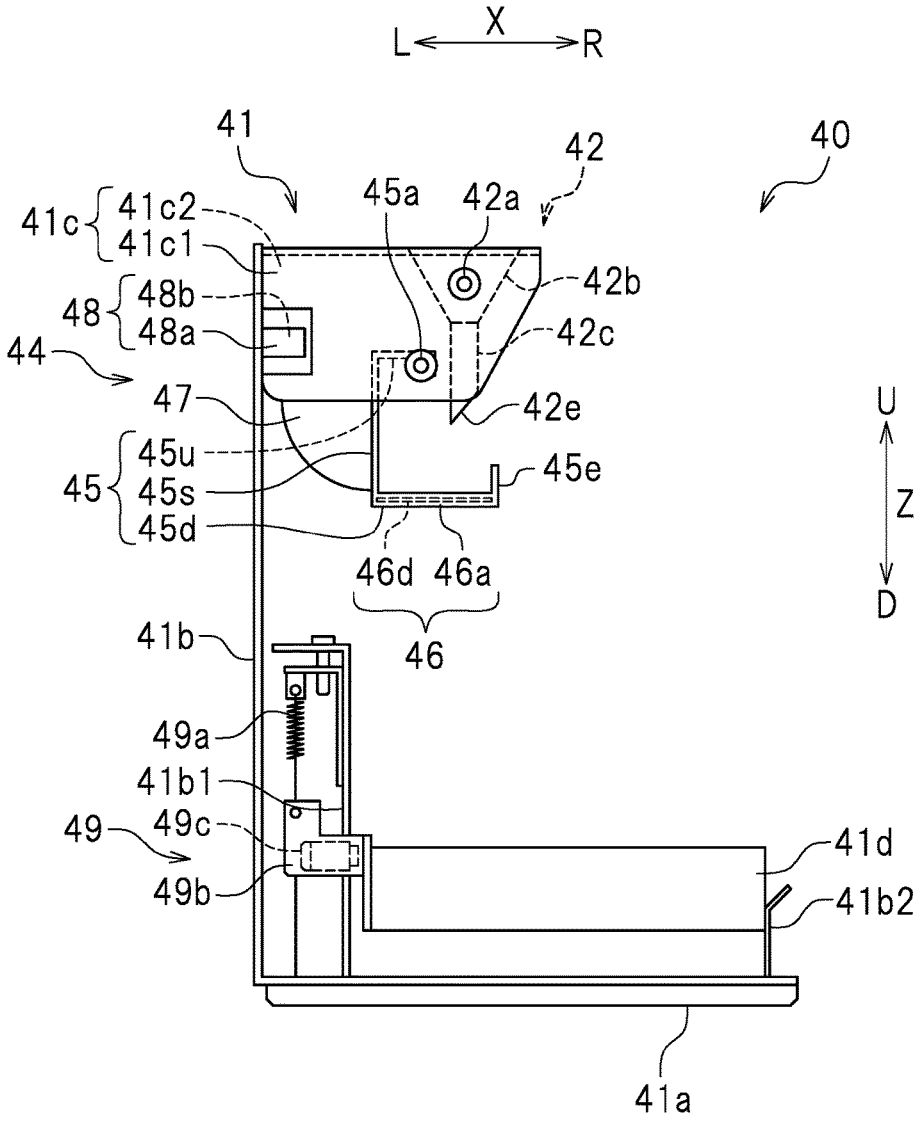
FIG. 5 is a side view of the waste ink mechanism shown in FIG. 4 in a state where a waste ink tank is detached.

FIG. 4 is a side view of the waste ink mechanism 40 in a preferred embodiment of the present invention. FIG. 5 is a side view of the waste ink mechanism 40 in a state where a waste ink tank 43 is detached. The waste ink mechanism 40 includes a case 41, a funnel 42, the waste ink tank 43, a first detector 44, and a second detector 49. The first detector 44 is an example of a detector that detects whether the waste ink tank 43 is present or absent. The second detector 49 is an example of a detector that detects whether or not the waste ink tank 43 is to be replaced. The first detector 44 and the second detector 49 are both optical detectors. The second detector 49 is not indispensable and may be omitted. The second detector 49 may have a function of detecting whether the waste ink tank 43 is present or absent like the first detector 44, instead of, or in addition to, the function of detecting whether or not the waste ink tank 43 is to be replaced.

The case 41 is located to enclose the waste ink tank 43 on three sides, more specifically, top, left and bottom sides of the waste ink tank 43. The case 41 is made of, for example, a metal material such as copper, stainless steel, aluminum or the like. The case 41 includes a bottom wall 41*a*, a side wall 41*b* and a top wall 41*c*. The bottom wall 41*a* extends in the left-right direction X along a bottom surface of the second area 17. The side wall 41*b* extends upward from a left end of the bottom wall 41*a*. The side wall 41*b* is located to be along the partition member (see FIG. 2). The top wall 41*c* extends rightward from a top end of the side wall 41*b*. The top wall 41*c* includes a first partition wall 41*c*1 and a second partition wall 41*c*2. The first partition wall 41*c*1 and the second partition wall 41*c*2 extend in the up-down direction Z and the left-right direction X. The first partition wall 41*c*1 and the second partition wall 41*c*2 are located parallel to each other while being adjacent to each other in the front-rear direction Y. The first partition wall 41*c*1 is located to the front of the second partition wall 41*c*2.

A tray 41*d* is placed on the bottom wall 41*a*. An XY plane of the bottom wall 41*a* is larger than a bottom surface of the tray 41*d*. The tray 41*d* acts as a mark that shows the user the position of the waste ink tank 43. The tray 41*d* is a container that receives the waste ink in the case where, for example, the waste ink tank 43 is overflown with the waste ink or the user inadvertently brings down the waste ink tank 43 to cause the waste ink to flow out of the waste ink tank 43. The tray 41*d* is slidable along a second standing wall 41*b*2 extending from the bottom wall 41*a*. The tray 41*d* is movable in the up-down direction Z.

The funnel 42 is structured to receive the waste ink from the waste ink path 34. The funnel 42 is a second waste ink path that guides the waste ink from the waste ink path 34 to the waste ink tank 43 in the waste ink mechanism 40. The funnel 42 is made of, for example, a metal material such as copper, stainless steel, aluminum or the like or a resin such as polyethylene, polypropylene, silicone, fluorine-based resin or the like. The funnel 42 is attached to the top wall 41*c* by a securing member 42*a*. The funnel 42 extends through an inner space of the top wall 41*c* in the up-down direction Z.

The funnel 42 includes a conical portion 42*b* having an inner diameter increasing upward and a cylindrical tube portion 42*c* extending downward from the conical portion 42*b*. The inner diameter of the conical portion 42*b* of the funnel 42 at a top end thereof is longer than an outer diameter of the waste ink path 34. An end of the waste ink path 34 is inserted into the conical portion 42*b* of the funnel 42. A bottom end 42*e* of the tube portion 42*c* is an example of an outlet. The bottom end 42*e* of the tube portion 42*c* is located blow a top surface of the waste ink tank 43 (top end of a neck portion 43*h* described below). The bottom end 42*e* of the tube portion 42*c* is cut obliquely such that the bottom end 42*e* is inclined downward and also forward (leftward in FIG. 4) with respect to a direction in which the waste ink tank 43 is inserted. The bottom end 42*e* of the tube portion 42*c* is inclined downward and leftward in FIG. 4. The bottom end 42*e* of the tube portion 42*c* is opened rearward (rightward in FIG. 4) with respect to the direction in which the waste ink tank 43 is inserted. The tube portion 42*c* of the funnel 42 is inserted into the neck portion 43*h* of the waste ink tank 43.

The waste ink tank 43 is a container in which the waste ink is collected. The waste ink tank 43 is an example of a waste liquid tank. The waste ink tank 43 is formed of, for example, a resin such as polyethylene, polypropylene, silicone, fluorine-based resin or the like. The waste ink tank 43 may be black and light-blocking. The waste ink tank 43 has a flat parallelepiped shape. The waste ink tank 43 includes a pair of wide surfaces 43*w* and a pair of narrow surfaces 43*n*. The wide surfaces 43*w* extend in the left-right direction X. The narrow surfaces 43*n* extend in the front-rear direction Y. Alternatively, the waste ink tank 43 may be, for example, cylindrical, cubic, bag-shaped or the like. The waste ink tank 43 includes the neck portion 43*h*, which is cylindrical. In the neck portion 43*h*, an opening 43*h*1 opened upward is provided. The top end of the neck portion 43*h* is set at generally the same height level as a flat top surface of the waste ink tank 43. The neck portion 43*h* is located below the funnel 42. An inner diameter of the neck portion 42*h* is longer than an outer diameter of the tube portion 42*c* of the funnel 42. The tube portion 42*c* of the funnel 42 is inserted into the neck portion 42*h*.

In preferred embodiment 1, the waste ink tank 43 is located inside the casing 12. In the case where the waste ink tank 43 is located inside the casing 12, the user operating the printer 10 cannot not easily see the waste ink tank 43 and cannot easily distinguish visually whether or not the waste ink tank 43 is at a predetermined position. The cured UV ink used in the printer 10 may be attached to an inner surface of the waste ink tank 43, or the waste ink tank 43 may be black and light-blocking. In such a case, the user cannot visually check the amount of the ink collected in the waste ink tank 43. Therefore, it is effective to adopt the technology disclosed herein. The waste ink tank 43 may be located outside the casing 12.

The first detector 44 includes a swingable member 45 and a sensor 48. In this example, the swingable member 45 and the sensor 48 are both attached to the first partition wall 41*c*1. The swingable member 45 and the sensor 48 do not need to be attached to the same member. The sensor 48 may be attached to, for example, a top portion of the side wall 41*b*.

The swingable member 45 is attached to the first partition wall 41*c*1 by a securing member 45*a*. The swingable member 45 is swingable on a circular track in a direction of gravitational force about the securing member 45*a* acting as the support. The swingable member 45 is not connected with the controller 50, and is swung by an operation of the user of attaching the waste ink tank 43. The swingable member 45 is an example of a displaceable member. The swingable member 45 is made of, for example, a metal material such as copper, stainless steel, aluminum or the like. The swingable member 45 is bent to be generally C-shaped as seen in a side view. The swingable member 45 includes a first side arm 45*u*, a center arm 45*s* and a second side arm 45*d*. The first side arm 45*u* is attached to the top wall 41*c* by the securing member 45*a*. As shown in FIG. 5, the first side arm 45*u* extends leftward from the securing member 45*a* in a state where the waste ink tank 43 is detached. The center arm 45*s* extends downward from the first side arm 45*u* in a state where the waste ink tank 43 is detached. The second side arm 45*d* extends rightward from the center arm 45*s* in a state where the waste ink tank 43 is detached. The first side arm 45*u* and the second side arm 45*d* are parallel or substantially parallel to each other. The first side arm 45*u* and the center arm 45*s* are perpendicular or substantially perpendicular to each other. The center arm 45*s* and the second arm 45*d* are perpendicular or substantially perpendicular to each other. The first side arm 45*u*, the center arm 45*s* and the second side arm 45*d* are each flat and plate-shaped.

As shown in FIG. 4, in a state where the waste ink tank 43 is attached, a wall 45*e* of the swingable member 45 is in contact with one of the narrow surfaces 43*n* of the waste ink tank 43. With such a structure, in a state where the waste ink tank 43 is attached, the swingable member 45 is supported by the securing member 45*a* and the waste ink tank 43. Therefore, the swingable member 45 stops still at a first position against the weight thereof (see FIG. 4). By contrast, in a state where the waste ink tank 43 is detached, the swingable member 45 is swung about the securing member 45*a* acting as the support. The swingable member 45 stops still at a second position, where it is balanced with the weight thereof (see FIG. 5).

The swingable member 45 is provided with an ink receiving portion 46 and also a blocking portion 47 detected by the sensor 48. The blocking portion 47 is physically integrated with the ink receiving portion 46 and is always displaced together with the ink receiving portion 46. The ink receiving portion 46 is provided on the second side arm 45*d* of the swingable member 45. The blocking portion 47 is provided on the center arm 45*s* of the swingable member 45. The blocking portion 47 is displaced to a first detection position when the swingable member 45 moves to the first position. The blocking portion 47 is displaced to a second detection position when the swingable member 45 moves to the second position. The blocking portion 47 is an example of a detection target, which is to be detected.

The ink receiving portion 46 is defined by the second side arm 45*d* and walls 45*s* (center arm), 45*e* and 46*a*, which extend upward from a left wall, a right wall, a front wall and a rear wall of the second side arm 45*d*. The ink receiving portion 46 is an example of a liquid receiving portion. The ink receiving portion 46 is structured to be located directly below the bottom end 42*e* of the funnel 42 by the weight of the swingable member 45 when the waste ink tank 43 is detached. In the state where the waste ink tank 43 is detached, the ink receiving portion 46 is typically horizontal. In this state, an XY plane of the ink receiving portion 46 is larger than an area size of the bottom end 42*e* of the tube portion 42*c* of the funnel 42 as seen in a plan view. In other words, a length in the front-rear direction Y of the ink receiving portion 46 is longer than a length in the front-rear direction Y of the bottom end 42*e* of the tube portion 42*c* of the funnel 42. A length in the left-right direction X of the ink receiving portion 46 is longer than a length in the left-right direction X of the bottom end 42*e* of the tube portion 42*c* of the funnel 42. With such a structure, when the waste ink tank 43 is detached, the ink receiving portion 46 receives the ink dripping from the tube portion 42*c* of the funnel 46 and thus properly prevents the ink from leaking inside the printer 10. The walls 45*s*, 45*e* and 46*a* of the ink receiving portion 46 prevent the ink from flowing out of the ink receiving portion 46.

A pad 46*d* is placed on a bottom surface of the ink receiving portion 46, namely, on a surface of the second side arm 45*d*. The pad 46 is made of an ink-absorbing material. The pad 46*d* is made of, for example, a resin such as polyolefin or the like. The pad 46*d* is typically made of a porous material, for example, sponge. The pad 46*d* is not indispensable and may be omitted.

The blocking portion 47 has a shape obtained as a result of equally dividing a circle into four, namely, is fan-shaped having a central angle of 90 degrees, as seen in a side view. The blocking portion 47 is structured to move to a position below the sensor 48 by the weight of the swingable member 45 when the waste ink tank 43 is detached. Along with the swinging of the swingable member 45, the blocking portion 47 is swung on a circular track about the securing member 45*a* acting as the support. The blocking portion 47 is structured to move upward and approach the sensor 48 when the waste ink tank 43 is attached.

The sensor 48 is structured to detect whether the waste ink tank 43 is present or absent based on the swinging of the blocking portion 47. The sensor 48 is electrically connected with the controller 50, and is controlled by the controller 50. The sensor 48 is attached to the first partition wall 41*c*1. The sensor 48 may be any known sensor. The sensor 48 is, for example, a light-transmissive or light-reflective photosensor. A photosensor responses quickly and therefore, detects whether the waste ink tank 43 is present or absent in real time with high precision. In the case of being a light-transmissive photosensor, the sensor 48 includes a light emitter 48*a* and a light receiver 48*b*.

In the sensor 48, light is directed from the light emitter 48*a* toward the light receiver 48*b*. The blocking portion 47 is structured to be capable of being between the light emitter 48*a* and the light receiver 48*b* of the sensor 48. When the blocking portion 47 is located between the light emitter 48*a* and the light receiver 48*b* along with the swinging of the swingable member 45, the light advancing from the light emitter 48*a* toward the light receiver 48*b* is blocked. The amount of light received by the light receiver 48*b* (amount of received light) is input to the controller 50 from the light receiver 48*b*. Based on the value of the amount of light (amount of light blocked by the blocking portion 47), the first detector 44 detects whether the waste ink tank 43 is present or absent.

The second detector 49 includes a loading spring 49*a*, a blocking portion 49*b* and a sensor 49*c*. An end of the loading spring 49*a* is coupled with the tray 41*d* via the blocking portion 49*b*. The loading spring 49*a* loads the tray 41*d* upward. The loading spring 49*a* is, for example, a spiral spring. The loading spring 49*a* has an elastic force adjusted to be well balanced with a sum of the weight of the waste ink tank 43 and a weight of a predetermined amount of waste ink. The loading spring 49*a* is an example of an energizing member. The blocking portion 49*b* is L-shaped as seen in a side view. The blocking portion 49*b* is located between the loading spring 49*a* and the tray 41*d*. The sensor 49*c* is structured to detect whether or not the waste ink tank 43 is to be replaced. The sensor 49*c* is electrically connected with the controller 50, and is controlled by the controller 50. The sensor 49*c* is attached to a first standing wall 41*b*1 extending upward from the bottom wall 41*a*. The first standing wall 41*b*1 extends parallel or substantially parallel to the side wall 41*b* and the second standing wall 41*b*2. The sensor 49*c* may be any known sensor. The sensor 49*c* is, for example, a light-transmissive or light-reflective photosensor. For example, the sensor 49*c* is a light-transmissive photosensor and includes a light emitter and a light receiver (not shown), like the sensor 48. The sensor 49*c* is structured such that the blocking portion 49*b* may be located between the light emitter and the light receiver.

In the state where the waste ink tank 43 is not placed on the tray 41*d*, and in a state where a predetermined amount of waste ink is not collected in the waste ink tank 43, the blocking portion 49*b* is pushed upward by the elastic force of the loading spring 49*a* (see FIG. 5). In this state, the blocking portion 49*b* is located between the light emitter and the light receiver of the sensor 49*c*. Therefore, the light advancing from the light emitter toward the light receiver is blocked by the blocking portion 49*b*. By contrast, when the waste ink is gradually accumulated in the waste ink tank 43 and as a result, a predetermined amount of waste ink is collected in the waste ink tank 43, the blocking portion 49*b* is pushed downward by the weight of the waste ink tank 43 and the weight of the predetermined amount of waste ink, against the elastic force of the loading spring 49*a* (see FIG. 4). In this manner, the blocking portion 49*b* moves to a position below the sensor 49*c*, namely, comes out of an area between the light emitter and the light receiver of the sensor 49*c*. As a result, the amount of light received by the light receiver of the sensor 49*c* (amount of received light) is increased. Information on the amount of received light is input to the controller 50 from the light receiver of the sensor 49*c*. Based on the value of the amount of received light, the second detector 49 detects whether or not the waste ink tank 43 is to be replaced.

The controller 50 controls operations of various components of the printer 10. The controller 50 is typically a computer. The controller 50 is configured or programmed to include, for example, an interface (I/F) receiving printing data, a central processing unit (CPU) executing an instruction of a control program, a ROM (read only memory) storing the program to be executed by the CPU, a RAM (random access memory) usable as a working area where the program is developed, and a storage, such as a memory or the like, storing the above-described program and various types of data.

Figure 6:
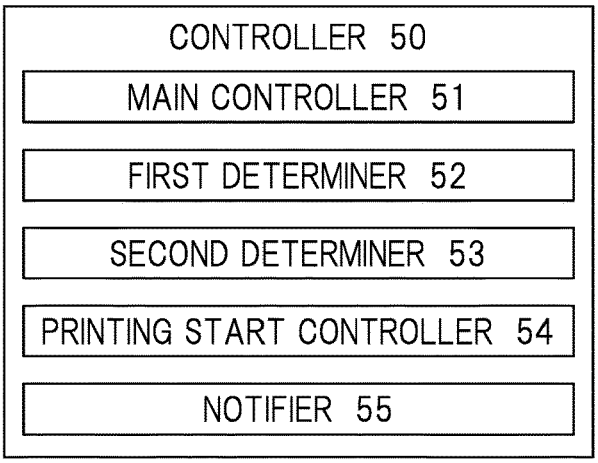
FIG. 6 is a block diagram showing a structure of a controller in preferred embodiment 1 according to the present invention.

FIG. 6 is a block diagram showing a structure of the controller 50. The controller 50 is configured or programmed to include a main controller 51, a first determiner 52, a second determiner 53, a printing start controller 54, and a notifier 55. In the case where the waste ink tank mechanism 40 does not include the second detector 49, the second determiner 53 may be omitted. These components of the controller 50 are communicable with each other. The functions of the components of the controller 50 may be provided by processors, or the components are incorporated into a circuit.

The main controller 51 controls a printing operation. The main controller 51 is communicably connected with the carriage motor of the carriage moving mechanism and the front-rear moving motor of the table moving mechanism 26, and controls the positional relationship between the printing target 25*a* and the ink heads 22. The main controller 51 is communicably connected with the ink heads 22, and controls the injection of the ink toward the printing target 25*a*. The main controller 51 is communicably connected with the ultraviolet lamps 23, and controls the ultraviolet lamps 23 to start or stop. The main controller 51 is communicably connected with the light emitter 48*a* of the sensor 48, and controls the output of the light from the light emitter 48*a*.

The main controller 51 is communicably connected with the cap moving mechanisms 32 and the suction pumps 33 of the cleaning mechanism 30, and controls a cleaning operation. The main controller 51 may be structured to, for example, control the cleaning mechanism 30 such that the cleaning mechanism 30 performs the cleaning operation when printing is resumed after being stopped for a long time. The main controller 51 may be structured to, for example, control the cleaning mechanism 30 such that the cleaning mechanism 30 performs the cleaning operation upon an instruction from the user when the user recognizes that a printing fault is caused to an image.

The first determiner 52 is communicably connected with the light receiver 48*b* of the sensor 48. The amount of received light is input to the first determiner 52 from the light receiver 48*b*. The first determiner 52 calculates the amount of light blocked by the blocking portion 47 (amount of blocked light) based on a difference between the amount of light output from the light emitter 48*a* (amount of output light) and the amount of light received by the light receiver 48*b* (amount of received light). The amount of blocked light is different depending on whether the blocking portion 47 is displaced to the first detection position or the second detection position. The first determiner 52 is structured to determine whether the waste ink tank 43 is present or absent based on the value of the amount of blocked light. In the case where, for example, the amount of blocked light is a predetermined reference value or smaller, the first determiner 52 determines that the waste ink tank 43 is absent, namely, the waste ink tank 43 is detached. By contrast, in the case where the amount of blocked light exceeds the predetermined reference value, the first determiner 52 determines that the waste ink tank 43 is attached.

The second determiner 53 is communicably connected with the light receiver of the sensor 49*c*. The amount of light received by the sensor 49*c* is input to the second determiner 53. The second determiner 53 is structured to determine whether or not a predetermined amount of waste ink is collected in the waste ink tank 43, based on the amount of light received by the light receiver of the sensor 49*c*. In the case where, for example, the sensor 49 is in a first state where the amount of received light is relatively small, the second determiner 53 determines that the predetermined amount of waste ink is not collected in the waste ink tank 43. In other words, the second determiner 53 determines that an extra space accommodating the waste ink is still left in the waste ink tank 43. By contrast, in the case where the sensor 49*c* is in a second state where the amount of received light is relatively large, the second determiner 53 determines that the predetermined amount of waste ink is collected in the waste ink tank 43.

The printing start controller 54 is structured to control the state of the printer 10 based on the determination results of the first determiner 52 and the second determiner 53. In the case where, for example, the first determiner 52 determines that the waste ink tank 43 is attached, the printing start controller 54 puts the printer 10 into a printing wait state where printing may be started. By contrast, in the case where the first determiner 52 determines that the waste ink tank 43 is not attached, the printing start controller 54 puts the printer 10 into a state where printing cannot be started. In other words, the printing start controller 54 locks the printer 10 such that the printer 10 cannot perform printing unless the waste ink tank 43 is attached. In the case where, for example, the second determiner 53 determines that the predetermined amount of waste ink is collected in the waste ink tank 43, the printing start controller 54 does not release the printer 10 from the stop state. In other words, the printing start controller 54 locks the printer 10 such that the printer 10 cannot perform printing in the case where the waste ink tank 43 has no room for further waste ink (having a remaining capacity). In this manner, the printer 10 is not actuated even if the user instructs the printer 10 to start printing in a state where the waste ink tank 43 is not attached and/or the waste ink tank 43 is full. Therefore, the waste ink is prevented from being scattered on the tray 41*d* or inside the printer 10.

The notifier 55 is structured to notify the user of an error based on the determination results of the first determiner 52 and the second determiner 53. In the case where, for example, the first determiner 52 determines that the waste ink tank 43 is not attached, the notifier 55 notifies the user of an error. In the case where, for example, the second determiner 53 determines that the predetermined amount of waste ink is collected in the waste ink tank 43, the notifier 55 notifies the user that the waste ink tank 43 is full. For example, the notifier 55 may display a message that the waste ink tank 43 is not attached and/or that the waste ink tank 43 is full on a display screen (not shown) included in the printer 10 by way of letters or illustrations. Alternatively, the notifier 55 may notify that the waste ink tank 43 is not attached and/or that the waste ink tank 43 is full by way of a sound such as an alert sound, a voice or the like. In this manner, the user recognizes that the waste ink tank 43 is not attached and/or that the waste ink tank 43 is full. The user does not need to check whether or not the waste ink tank 43 is at a predetermined position each time the printing is to be started, or to pay attention to the amount of waste ink in the waste ink tank 43 during the printing. This alleviates the working load on the user.

Figure 7:
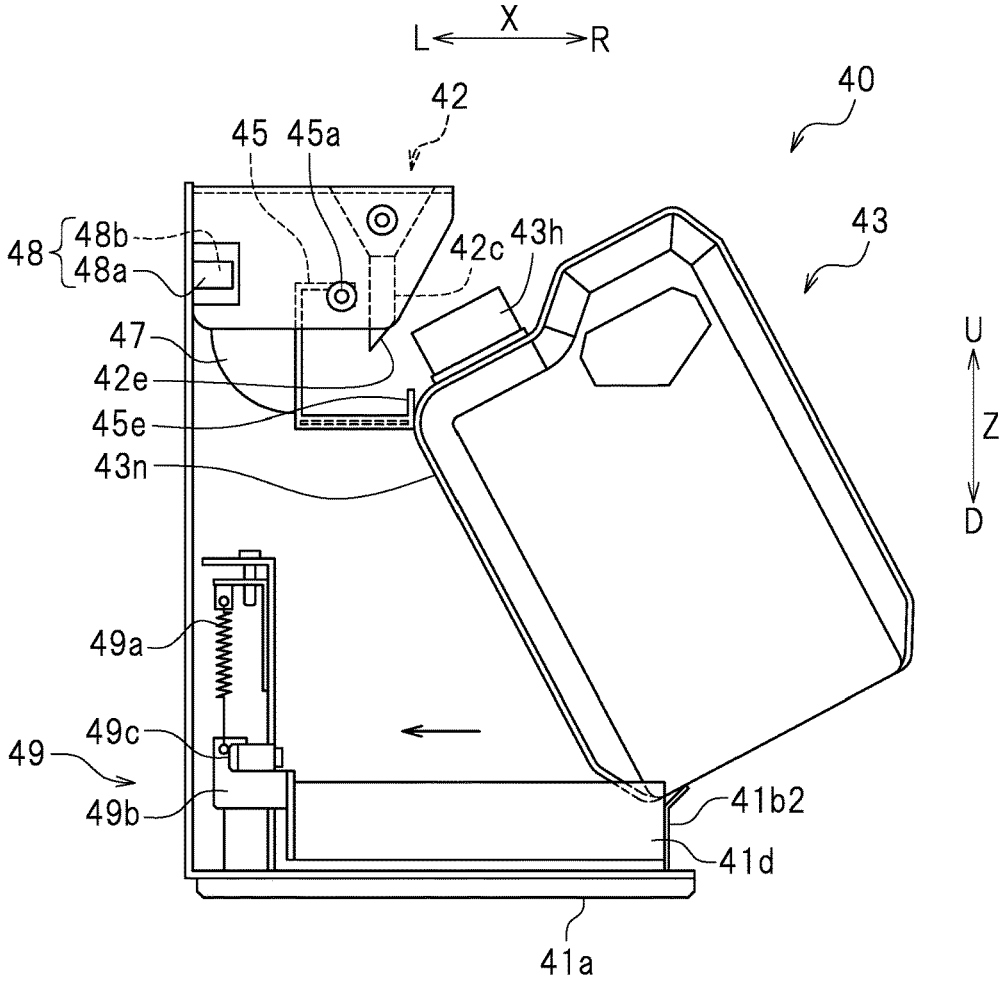
FIG. 7 is a side view of the waste ink mechanism showing how the waste ink tank is attached in preferred embodiment 1 according to the present invention.

FIG. 7 is a side view of the waste ink mechanism 40 showing how the waste ink tank 43 is attached. FIG. 7 shows only some of the reference signs. As represented by the arrow in FIG. 7, in order to locate the waste ink tank 43 in the printer 10, the user inserts the waste ink tank 43 from the neck portion 43*h* along the bottom surface of the tray 41*d*. In preferred embodiment 1, the bottom end 42*e* of the tube portion 42*c* of the funnel 42 is obliquely cut. Therefore, when the waste ink tank 43 is inserted onto the tray 41*d*, the neck portion 43*h* of the waste ink tank 43 and the tube portion 42*c* of the funnel 42 do not easily interfere with each other. The waste ink tank 43 is inserted onto the tray 41*d* such that the neck portion 43*h* slides along an opening formed at the bottom end 42*e* of the tube portion 42*c* of the funnel 42. In this manner, the tube portion 42*c* is located in the neck portion 43*h* in a state where the waste ink tank 43 is located on the tray 41*d*.

When the waste ink tank 43 is inserted onto the tray 41*d*, one of the narrow surfaces 43*n* of the waste ink tank 43 contacts the wall 45*e* of the swingable member 45. When the waste ink tank 43 is inserted deeper, the swingable member 45 is pushed upward and swung about the securing member 45*a* acting as the support. When the waste ink tank 43 is placed on the tray 41*d*, the swingable member 45 stops still at the first position while being supported by the waste ink tank 43 as shown in FIG. 4. Along with this, the blocking portion 47 is located between the light emitter 48*a* and the light receiver 48*b* of the first detector 44. Therefore, the first determiner 52 determines that the waste ink tank 43 is attached. The blocking portion 49*b* of the second detector 49 is located between the light emitter and the light receiver. Therefore, the second determiner 53 determines that the waste ink tank 43 has a remaining capacity. As a result, the printing start controller 54 releases the printer 10 from the stop state. When the user instructs the printer 10 to start printing in a state where the printer 10 is released from the stop state, the printer 10 is actuated to perform printing on the printing target 25*a*.

As the printer 10 is performing printing or the cleaning operation, waste ink is gradually accumulated in the waste ink tank 43. When the predetermined amount of waste ink is collected in the waste ink tank 43, the tray 41*d* slides downward along the second standing wall 41*b*2, and the blocking portion 49*b* of the second detector 49 moves downward to come out of the area between the light emitter and the light receiver. As a result, the second determiner 53 determines that the waste ink tank 43 is full. In this state, even if the user instructs the printer 10 to start printing, the printing start controller 54 keeps the printer 10 in the stop state. Therefore, the user needs to detach the waste ink tank 43 and discharge the waste ink collected in the waste ink tank 43 or replace the waste ink tank 43 with a new one in order to actuate the printer 10 to perform printing.

In order to detach the waste ink tank 43, the user pulls the waste ink tank 43 along the bottom surface of the tray 41*d* in a direction opposite to that described above. As a result, the wall 45*e* of the swingable member 45 and the waste ink tank 43 move out of contact with each other. When this occurs, the swingable member 45 is swung about the securing member 45*a* acting as the support and stops still at a second position, where it is balanced with the weight thereof as shown in FIG. 5. Along with this, the blocking portion 47 moves to a position below the sensor 48 and thus moves out of the area between the light emitter 48*a* and the light receiver 48*b*. As a result, the first determiner 52 determines that the waste ink tank 43 is not attached. The printing start controller 54 keeps the printer 10 in the stop state. The notifier 55 notifies the user of an error.

As described above, in the printer 10 in preferred embodiment 1, the ink receiving portion 46 and the blocking portion 47 are both provided on the swingable member 45 and are integral with each other. This simplifies the structure of the components in the vicinity of the waste ink tank 43, and thus decreases the number of the components and the number of steps of assembling the components. The production cost of the printer 10 is also decreased. Simple control is made possible, and thus the load on the controller 50 is alleviated.

In preferred embodiment 1, the swingable member 45 includes the wall 45*e* contacting the waste ink tank 43 when the waste ink tank 43 is attached in the casing 12, and is structured to move from the second position to the first position by the wall 45*e* being pushed by the waste ink tank 43. With such a structure, a moving mechanism moving the swingable member 45 is made unnecessary. Therefore, the structure of the printer 10 is more simplified.

In preferred embodiment 1, the casing 12 includes the securing member (or shaft) 45*a*, and the swingable member 45 is swingably supported by the securing member 45*a*. With such a structure, a swinging mechanism driving the swingable member 45 is made unnecessary. Therefore, the structure of the printer 10 is more simplified.

In preferred embodiment 1, the shaft 45*a* extends in a horizontal direction, and the swingable member 45 is structured such that the ink receiving portion 46 is located directly below the outlet 42*e* by the weight of the swingable member 45 in a state where the waste ink tank 43 is not attached in the casing 12. The swingable member 45 is allowed to have a simpler structure by use of the weight thereof. Therefore, the effect of preventing the waste ink from dripping at the time of attaching and detaching the waste ink tank 43 and the effect of simplifying the structure of the printer 10 are both provided at a higher level.

In preferred embodiment 1, the casing 12 includes the top wall 41*c* as a single component that supports both of the swingable member 45 and the sensor 48. The structure in which the swingable member 45 and the sensor 48 are attached to the same component decreases an assembling error of the blocking portion 47 and the sensor 48. This increases the detection precision of the first detector 44.

The inkjet printer 10 in preferred embodiment 1 is described above. The inkjet printer according to the present invention is not limited to the above.

For example, in preferred embodiment 1 described above, an outer surface of the wall 45*e* of the swingable member 45 and the narrow surfaces 43*n* of the waste ink tank 43 are flat. The present invention is not limited to this. In the case where, for example, the waste ink tank 43 is cylindrical and has a curved circumferential surface, the outer surface of the wall 45*e* of the swingable member 45 may be concave in correspondence with the curved circumferential surface. Preferably, the outer surface of the wall 45*e* of the swingable member 45 and one of the narrow surfaces 43*n* of the waste ink tank 43 (more specifically, the narrow surface 43*n* to be in contact with the wall 45*e*) are shaped to be fitted to each other.

For example, in preferred embodiment 1 described above, the swingable member 45 is structured to stops still at a second position, where it is balanced with the weight thereof, in a state where the waste ink tank 43 is detached. The present invention is not limited to this. For example, the swingable member 45 may be loaded to be at the second position by an energizing member such as a spring or the like, and may be structured to move to the first position against the loading force of the energizing member when the waste ink tank 43 is attached by the user.

For example, in preferred embodiment 1 described above, the first detector 44 includes the optical sensor 48 and the second detector 49 includes the loading spring 49*a* and the optical sensor 49*c*. The present invention is not limited to this. The first detector 44 may include, for example, an angle sensor capable of directly detecting a swinging angle of the blocking portion 47, a position sensor capable of detecting the position of the blocking portion 47, or the like. The second detector 49 may be, for example, a non-contact sensor or a contact sensor.

Preferred Embodiment 2

Figure 8:
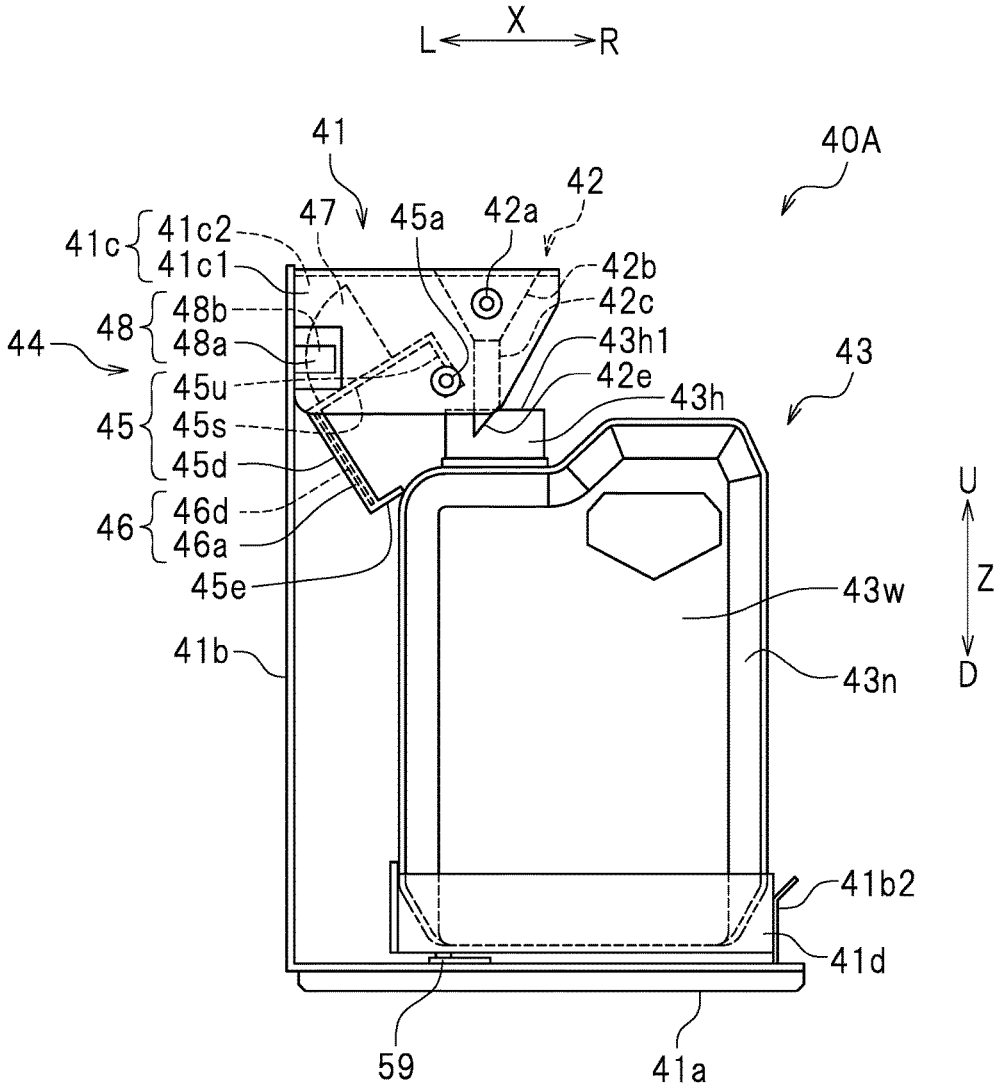
FIG. 8 is a side view of a waste ink mechanism in preferred embodiment 2 according to the present invention.

FIG. 8 is a side view of a waste ink mechanism 40A in preferred embodiment 2 according to the present invention. The waste ink mechanism 40A includes a second detector 59 instead of the second detector 49. The waste ink mechanism 40A has the same structure as that of the waste ink mechanism 40 in preferred embodiment 1 except for including the second detector 59. In preferred embodiment 2, the second detector 59 also detects whether the waste ink tank 43 is present or absent, like the first detector 44. The second detector 59 is provided on the bottom wall 41*a* and protrudes upward. The second detector 59 is a contact sensor. The second detector 59 may be, for example, a weight sensor or the like. As described above, the waste ink mechanism 40A includes two detectors that detect whether the waste ink tank 43 is present or absent. Therefore, even if one of the detectors malfunctions to cause an inconvenience, the other detector correctly detects whether the waste ink tank 43 is present or absent. The second detector 59 is electrically connected with the controller 50. The tray 41*d* is located above the second detector 59.

In the case where the waste ink tank 43 is not placed on the tray 41*d*, the second detector 59 is out of contact with the tray 41*d*. By contrast, when the waste ink tank 43 is placed on the tray 41*d*, the tray 41*d* is pushed downward by the weight of the waste ink tank 43. Therefore, the second detector 59 is put into contact with the tray 41*d* (see FIG. 8). The second detector 59 detects whether or not the waste ink tank 43 is attached, based on the contact/non-contact state of the second detector 59 and the tray 41*d*.

The second detector 59 may be structured to detect whether or not the waste ink tank 43 is to be replaced, like the second detector 49 included in the waste ink mechanism 40 in preferred embodiment 1. For example, the second detector 59 may include the loading spring 49*a* like the first detector 49, and the loading spring 49*a* may have an elastic force adjusted to be well balanced with a sum of the weight of the waste ink tank 43 and a weight of a predetermined amount of waste ink. In this case, at the time when the waste ink tank 43 is inserted onto the tray 41*d*, the tray 41*d* and the second detector 59 move out of contact with each other. Then, only when a predetermined amount of waste ink is collected in the waste ink tank 43, the tray 41*d* and the second detector 59 are put into contact with each other. In this manner, the elastic force of the loading spring 49*a* may be adjusted, so that the second detector 59 also detects whether or not the waste ink tank 43 is to be replaced.

For example, in preferred embodiment 1 described above, the printer 10 includes the ultraviolet lamps 23. The ultraviolet lamps 23 are not indispensable and may be omitted. In this case, the ink cartridges 21 may store ink other than UV ink.

In preferred embodiment 1 described above, the carriage 19 of the printer 10 is movable in the left-right direction X and the table 25 is movable in the front-rear direction Y. The present invention is not limited to this. The carriage 19 and the table 25 move with respect to each other, and either one of the carriage 19 and the table 25 may move in the left-right direction X or the front-rear direction Y. Alternatively, for example, the table 25 may be unmovable and the carriage 19 may be movable both in the left-right direction X and the front-rear direction Y.

Figure 9:
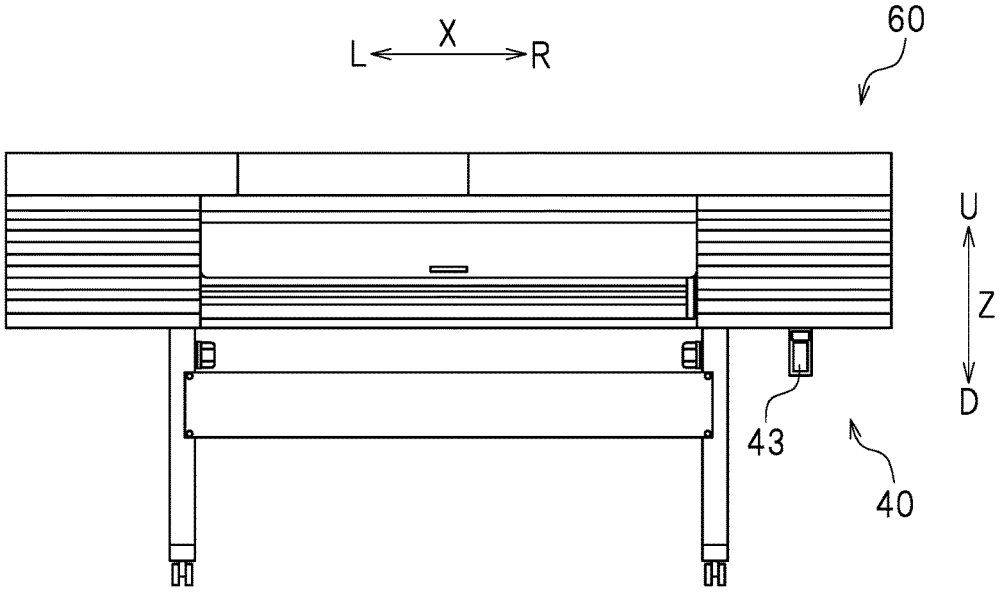
FIG. 9 is a front view of an inkjet printer in another preferred embodiment according to the present invention.

For example, in preferred embodiment 1 described above, the printer 10 is a so-called flatbed printer, and the waste ink mechanism 40 and the waste ink tank 43 are located inside the casing 12. The present invention is not limited to this. FIG. 9 is a front view of a so-called roll-to-roll printer 60. The printer 60 transfers a roll medium as a printing target. In the case of the printer 60, the waste ink mechanism 40 and the waste ink tank 43 are located outer to the casing 12.

Preferred Embodiment 3

Figure 10:
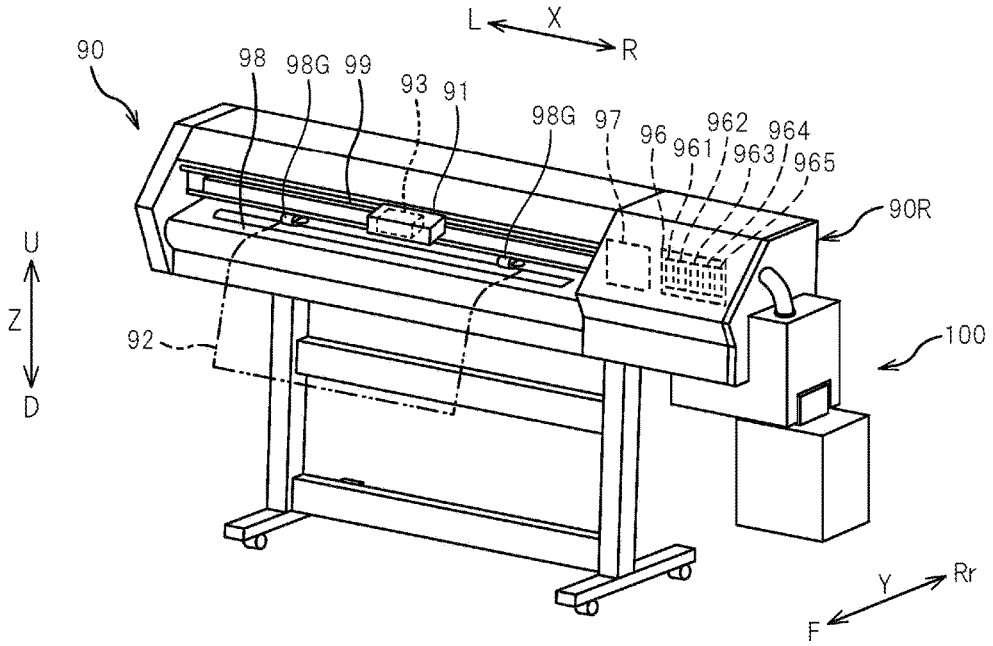
FIG. 10 is a perspective view of an inkjet printer in preferred embodiment 3 according to the present invention.
Figure 11:
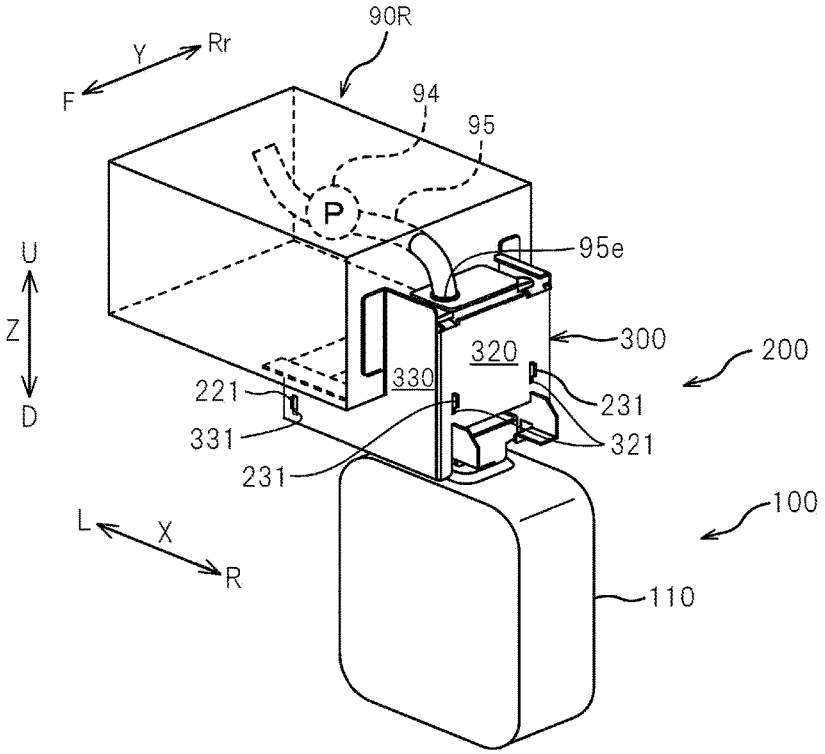
FIG. 11 is an enlarged view of a right end portion of the inkjet printer shown in FIG. 10.

FIG. 10 is a perspective view of a printer 90. FIG. 11 is an enlarged view of a right end portion of the printer 90 shown in FIG. 10. In FIG. 11, the structure of a right side cover 90R described below is shown in a simplified manner. Letters representing the directions FIG. 10, FIG. 11 and the figures referred to below represent the same directions as in the figures referred to in preferred embodiment 1. Hereinafter, differences from preferred embodiment 1 will be mainly described.

The printer 90 is a so-called roll-to-roll printer like the printer 60 shown in FIG. 9. The printer 90 includes a platen 98, a guide rail 99, a carriage 91, an ink head 93, a right side cover 90R, a cleaning mechanism 97, a waste ink path 95, a liquid supply pump 94, a waste ink mechanism 100, and a controller 96.

On the platen 98, a printing target (medium) 92 is placed at the time of printing. The platen 98 extends in the left-right direction X. Cylindrical grit rollers 98G are provided at a surface of the platen 98. The grit rollers 98G are buried in the platen 98 while top surfaces thereof are exposed. The grit rollers 98G are driven by a feed roller (not shown). The grit rollers 98G are each an example of a transfer mechanism that moves the printing target 92 in the front-rear direction Y. The guide rail 99, the carriage 91 and the ink head 93 are located above the platen 98. The guide rail 99, the carriage 91 and the ink head 93 may respectively have substantially the same structures as those of the guide rail 18, the carriage 19 and the ink heads 22 described in preferred embodiment 1. The carriage 91 is reciprocally movable by a carriage motor (not shown) in the left-right direction X along the guide rail 99. Along with this, the ink head 93 is movable in the left-right direction X together with the carriage 91. The ink head 93 injects ink from nozzles toward the printing target 92 on the platen 98.

The right side cover 90R is located to the right of the platen 98. The right side cover 90R is a portion of a device main body. While no printing is performed, for example, while the printer 90 is at a stop, the carriage 91 having the ink head 93 mounted thereon waits inside the right side cover 90R. The right side cover 90R accommodates ink cartridges (not shown) in communication with the ink head 93, the controller 96, the liquid supply pump 94, a portion of the waste ink path 95, and the cleaning mechanism 97 performing a cleaning operation on the ink head 93. The right side cover 90R may also accommodate a cleaning liquid tank (not shown) storing a cleaning liquid, a cleaning liquid supplier (not shown) or the like.

There is no specific limitation on the structure of the cleaning mechanism 97. The cleaning mechanism 97 may have, for example, substantially the same structure as that in preferred embodiment 1, and may be structured to perform a first cleaning operation of driving the liquid supply pump 94 to absorb the ink in the nozzles in a state where the openings of the nozzles of the ink head 93 are covered with caps (not shown). The cleaning mechanism 97 may include, for example, a flushing box (not shown) and may be structured to perform a second cleaning operation of discharging the ink toward the flushing box from the nozzles of the ink head 93. The waste ink path 95 is an example of a waste ink flow path that guides the ink discharged by the cleaning operation (waste ink) to the waste ink mechanism 100. The waste ink path 95 is, for example, a flexible ink tube. The liquid supply pump 94 is located in the middle of the waste ink path 95. The liquid supply pump 94 is an example of a liquid supplier that supplies the waste ink to the waste ink mechanism 100. The ink discharged by the cleaning operation (waste ink) is supplied to the waste ink mechanism 100 via the waste ink path 95.

Figure 12:
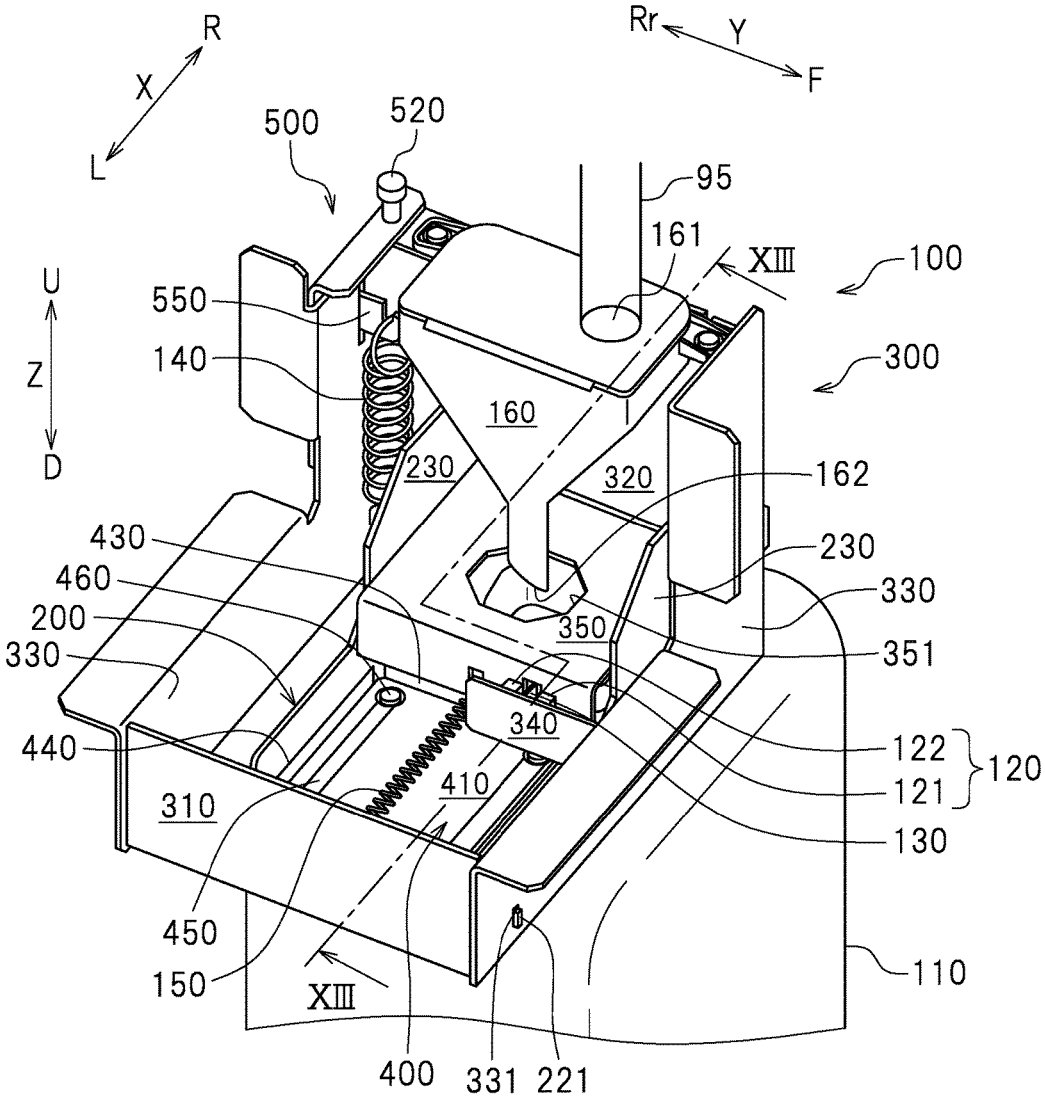
FIG. 12 is a perspective view of a waste ink mechanism in preferred embodiment 3 according to the present invention.
Figure 13:
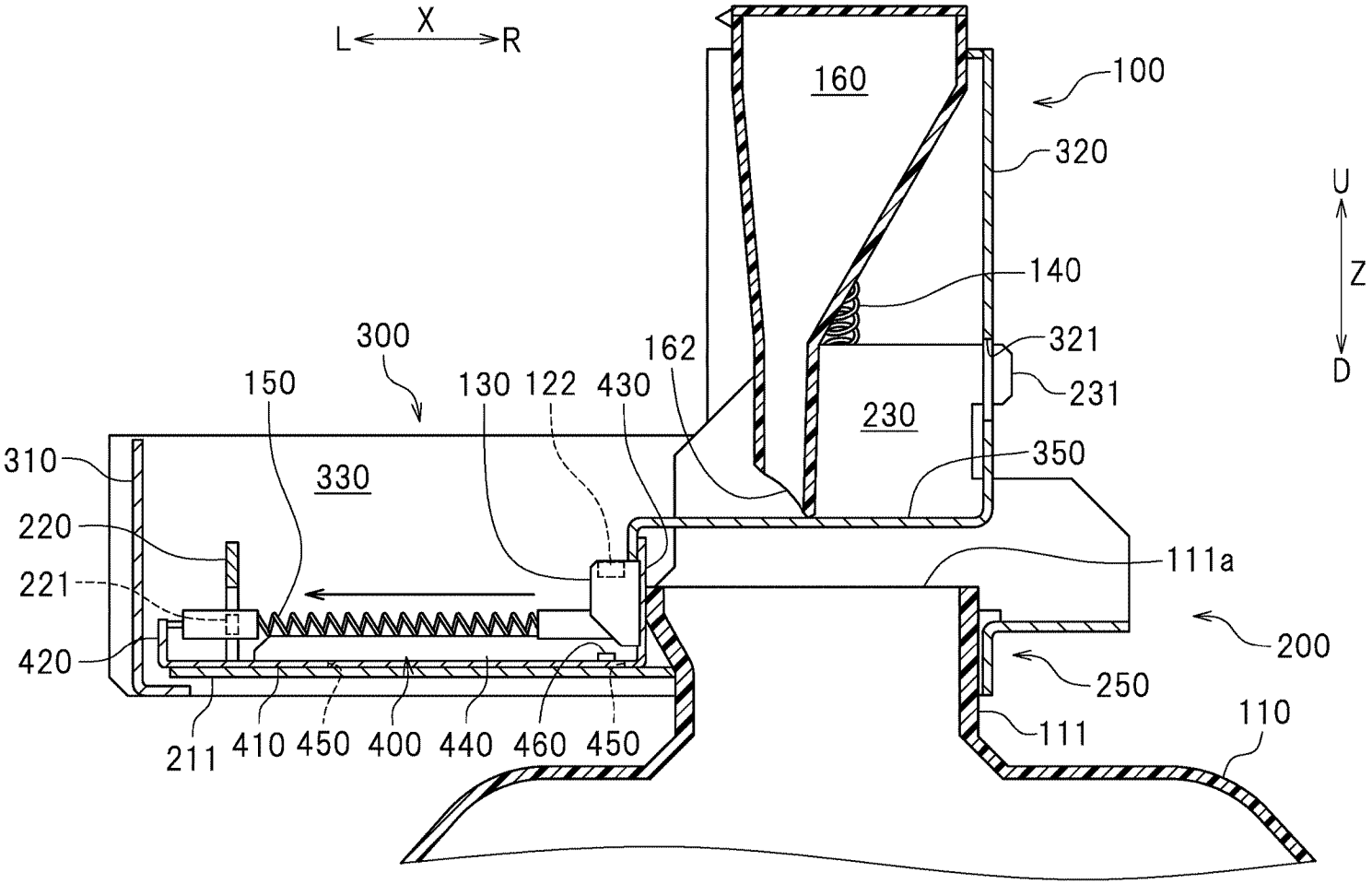
FIG. 13 is a cross-sectional view of the waste ink mechanism taken along line XIII-XIII in FIG. 12.
Figure 14:
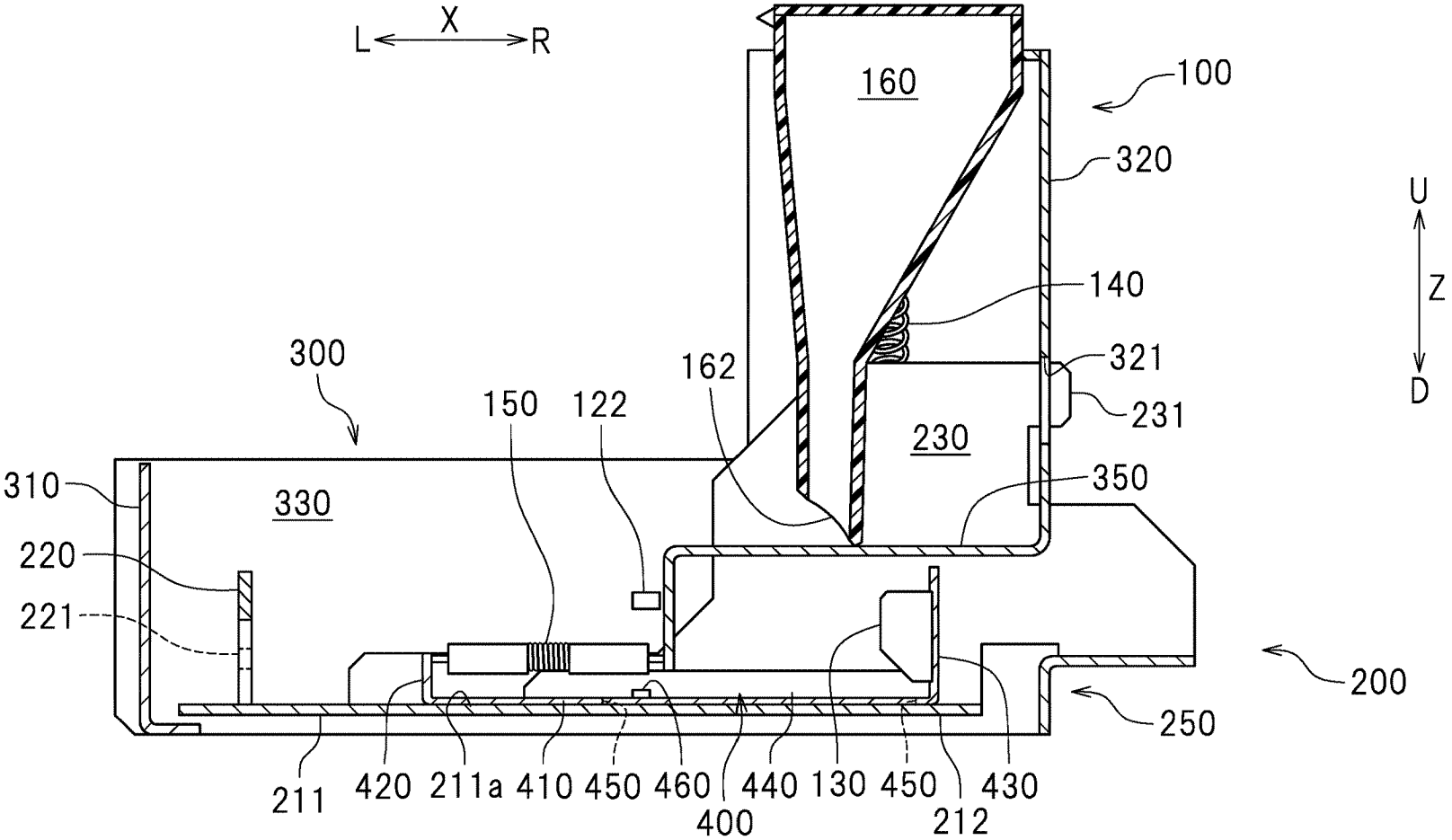
FIG. 14 is a cross-sectional view of the waste ink mechanism shown in FIG. 12 in a state where no waste ink tank is attached.
Figure 15:
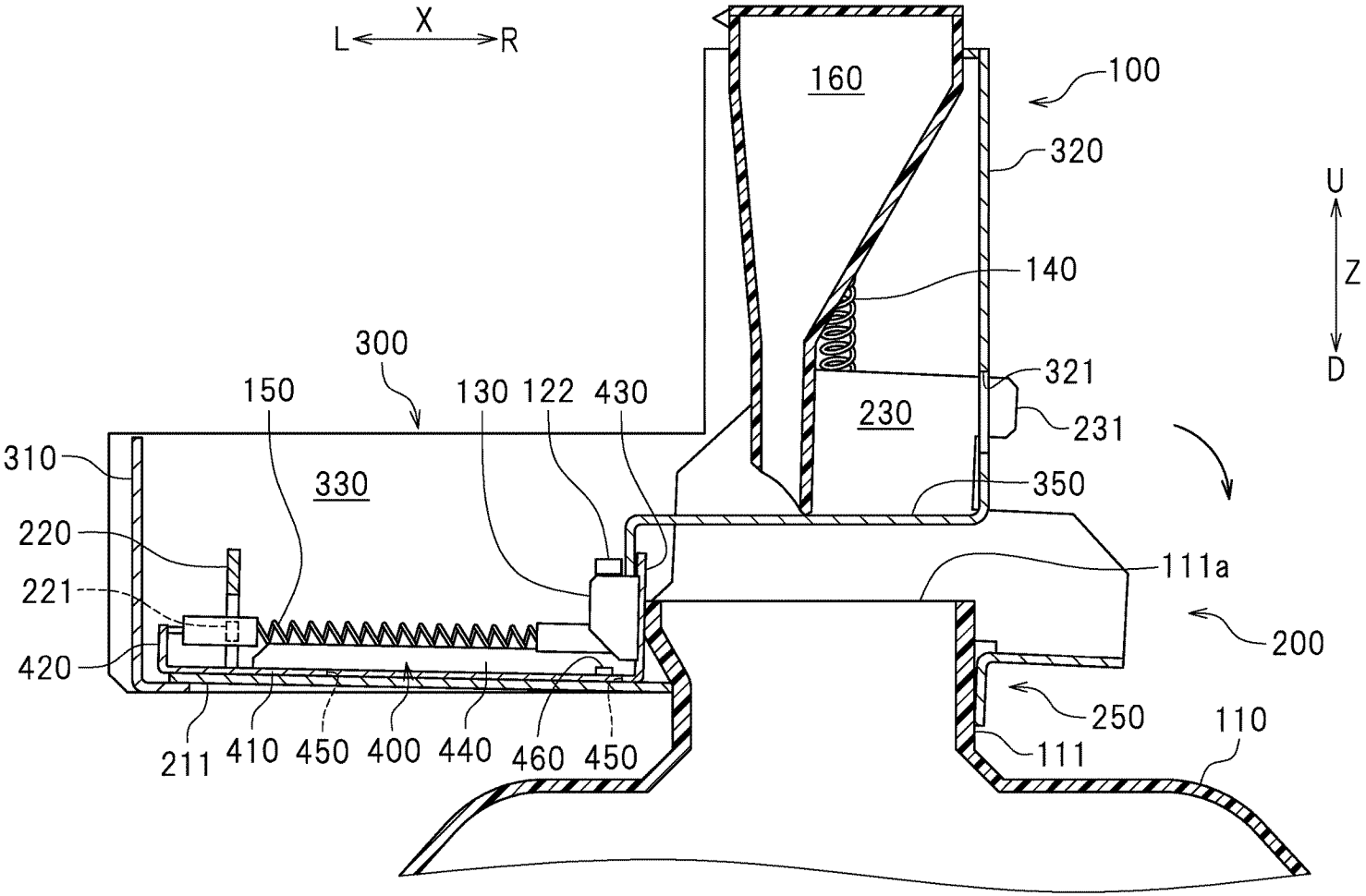
FIG. 15 is a cross-sectional view of the waste ink mechanism shown in FIG. 12 in a state where a waste ink tank is full.

FIG. 12 is a perspective view of the waste ink mechanism 100. FIG. 13 is a cross-sectional view of the waste ink mechanism 100 taken along line XIII-XIII in FIG. 12. FIG. 12 and FIG. 13 show a state where a waste ink tank 110 having a remaining capacity is attached to the waste ink mechanism 100 (hereinafter, such a state of the waste ink mechanism 100 will be referred to also as an "attached state"). FIG. 14 is a cross-sectional view of the waste ink mechanism 100 in a state where the waste ink tank 110 is not attached (hereinafter, such a state of the waste ink mechanism 100 will be referred to also as an "unattached state"). FIG. 15 is a cross-sectional view of the waste ink mechanism 100 in a state where the waste ink tank 110 is full (hereinafter, referred to also as a "full state").

The waste ink mechanism 100 is located outward of the right side cover 90R. The waste ink mechanism 100 collects waste ink discharged from the ink head 93 for a purpose other than printing an image (e.g., waste ink discharged by the first and/or second cleaning operation). The waste ink mechanism 100 includes the waste ink tank 110, a securing member 300, a funnel 160, a position adjusting member 500, a second loading spring 140, a support member 200, a shutter member 400, a first loading spring 150, a detection member 120, and a detection target 130.

The securing member 300 is attached to the right side cover 90R of the printer 90. The securing member 300 secures the waste ink mechanism 100 to the right side cover 90R. The securing member 300 includes a left wall 310, a right wall 320, a pair of side walls 330, a first attachment portion 340, and a second attachment portion 350. The left wall 310 and the right wall 320 are located to face each other in the left-right direction X. The pair of side walls 330 are located to face each other in the front-rear direction Y. The front side wall 330 connects a front end of the left wall 310 and a front end of the right wall 320 to each other. The rear sidewall 330 connects a rear end of the left wall 310 and a rear end of the right wall 320 to each other. The side walls 330 are each generally L-shaped with a left top portion being cut off. With such a shape, at least a portion of the waste ink mechanism 100 is located below the right side cover 90R, which decreases the size of the printer 90 in the left-right direction X.

As shown in FIG. 11, two receiving holes 321 are provided in the right wall 320. The two receiving holes 321 are spaced away from each other in the front-rear direction Y. The two receiving holes 321 are located at the same height level. The two receiving holes 321 are lengthy holes extending in the up-down direction Z. As shown in FIG. 11 and FIG. 12, a receiving hole 331 is provided in each of the pair of side walls 330. The two receiving holes 331 are lengthy holes extending in the up-down direction Z. The two receiving holes 331 are located at the same height level. The two receiving holes 331 are located at a level lower than that of the two receiving holes 321.

Figure 16:
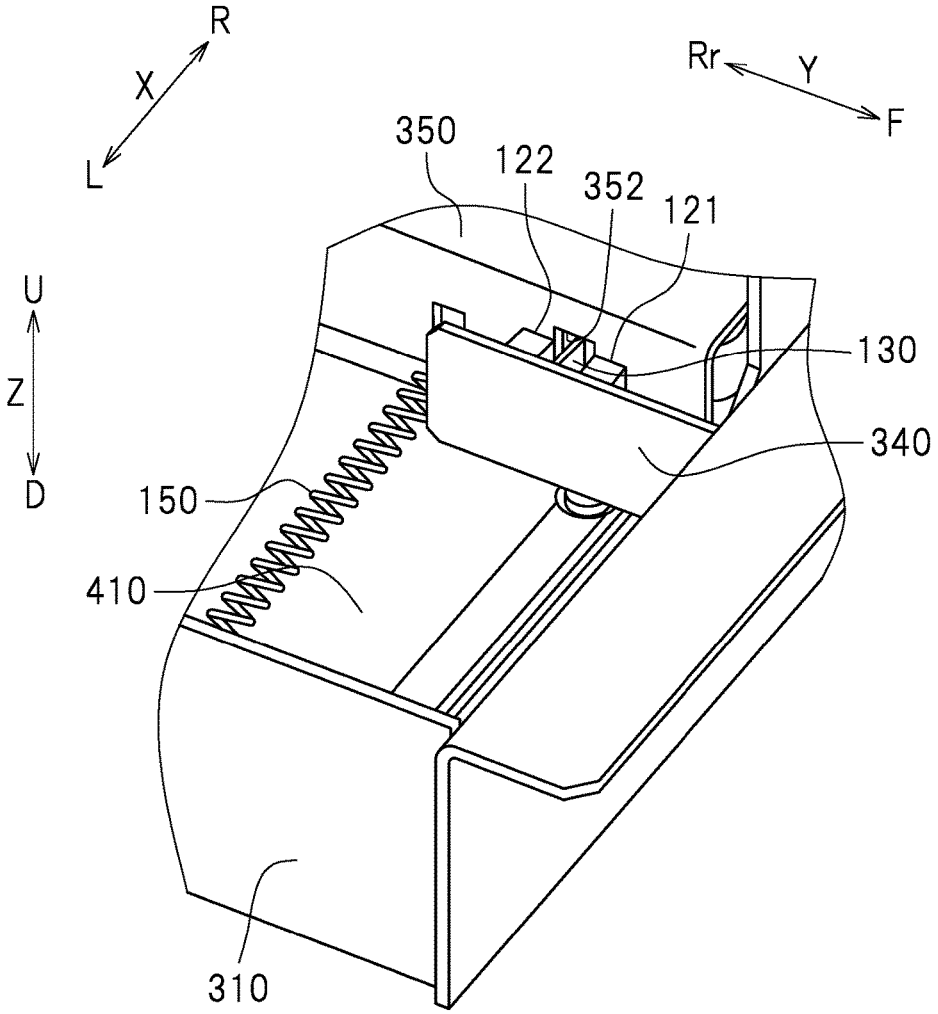
FIG. 16 is an enlarged view of a left end portion of a second attachment portion of the waste ink mechanism shown in FIG. 12.

The first attachment portion 340 is provided on the front side wall 330. The first attachment portion 340 extends rearward from the front side wall 330. The detection member 120 described below is attached on a right surface of the first attachment portion 340. The second attachment portion 350 extends leftward horizontally from the right wall 320. A left end of the second attachment portion 350 is bent downward at a generally right angle. FIG. 16 is an enlarged view of a left end portion of the second attachment portion 350. As shown in FIG. 16, an opening 352 is provided in a left end portion of the second attachment portion 350. The opening 352 is provided such that the detection target 130 attached to the shutter member 400 described below may enter the opening 352 by a movement of the shutter member 400. A right end of the first loading spring 150 described below is attached to the left end of the second attachment portion 350. A through-hole 351 extends through an XY plane of the second attachment portion 350 in the up-down direction Z. The funnel 160 is located above the through-hole 351.

The funnel 160 is attached to the right wall 320 of the securing member 300. The funnel 160 is secured to the right wall 320. The funnel 160 is located to the right of the right side cover 90R. The funnel 160 may be substantially the same as the funnel 42 in preferred embodiment 1. An inlet opening 161 of the funnel 160 is directed upward. The inlet opening 161 is in communication with a bottom end 95*e* of the waste ink path 95. The waste ink flows into the inlet opening 161 from the waste ink path 95. An outlet opening 162 of the funnel 160 is directed downward. The outlet opening 162 is located above an opening 111*a* of the waste ink tank 110. In the attached state, the waste ink is discharged from the outlet opening 162 into the waste ink tank 110. The outlet opening 162 is an example of an outlet.

The position adjusting member 500 is attached to the rear side wall 330 of the securing member 300. In more detail, the position adjusting member 500 is attached to a right surface of the rear side wall 330. The position adjusting member 500 is structured to be positionally adjustable in the up-down direction Z with respect to the securing member 300. The position adjusting member 500 is structured to adjust the position of the detection member 120 attached to the securing member 300. The position adjusting member 500 is structured to adjust the positions of the support member 200 and the shutter member 400 in the up-down direction Z with respect to the securing member 300, and thus to adjust the position, in the up-down direction Z, of the detection target 130 attached to the shutter member 400 with respect to the detection member 120 attached to the securing member 300.

Figure 17:
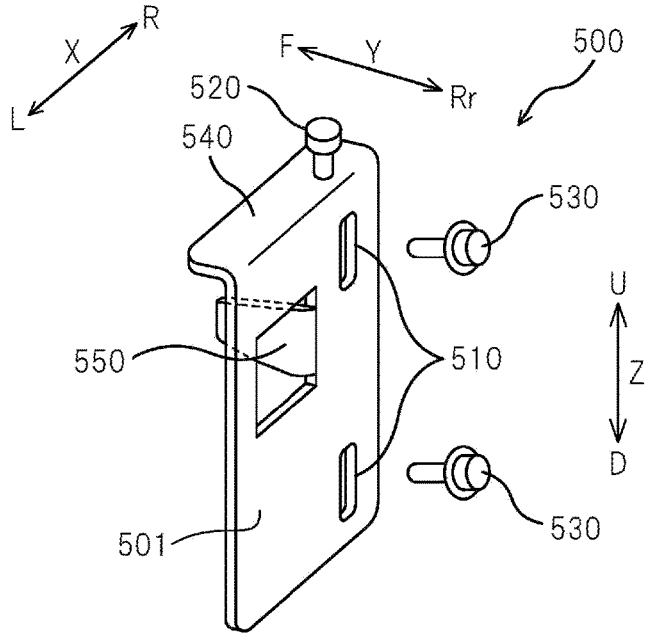
FIG. 17 is a perspective view of a position adjusting member of the waste ink mechanism shown in FIG. 12.

FIG. 17 is a perspective view of the position adjusting member 500. In FIG. 17, the front-rear direction Y is opposite to that in FIG. 12. The position adjusting member 500 includes a side wall 501, a top wall 540 and a suspending portion. The side wall 501 extends in the up-down direction Z along the rear side wall 330. The top wall 540 extends rearward from a top end of the side wall 501. The suspending portion 550 protrudes forward from the side wall 501. A top end of the second loading spring 140 is attached to the suspending portion 550. The position adjusting member 500 suspends the second loading spring 140.

Two slide holes 510 are provided in the side wall 501. The two slide holes 510 are lengthy holes extending in the up-down direction Z. Bolts 530 are inserted respectively into the two slide holes 510. The position adjusting member 500 is attached to the securing member 300 via the bolts 530. The bolts 530 are attached to be slidable in the up-down direction Z along the slide holes 510. With such a structure, the position adjusting member 500 is slidable in the up-down direction Z with respect to the securing member 300. An adjusting screw 520 is attached to the top wall 540. The adjusting screw 520 is used by the user in order to manually push the position adjusting member 500 downward. The user may use the adjusting screw 520 to easily fine-tune the position of the position adjusting member 500 in the up-down direction Z.

The support member 200 is attached to the securing member 300. The support member 200 is located inside the securing member 300, more specifically, in a space enclosed by the left wall 310, the right wall 320 and the pair of side walls 330. The support member 200 supports the waste ink tank 110.

Figure 18:
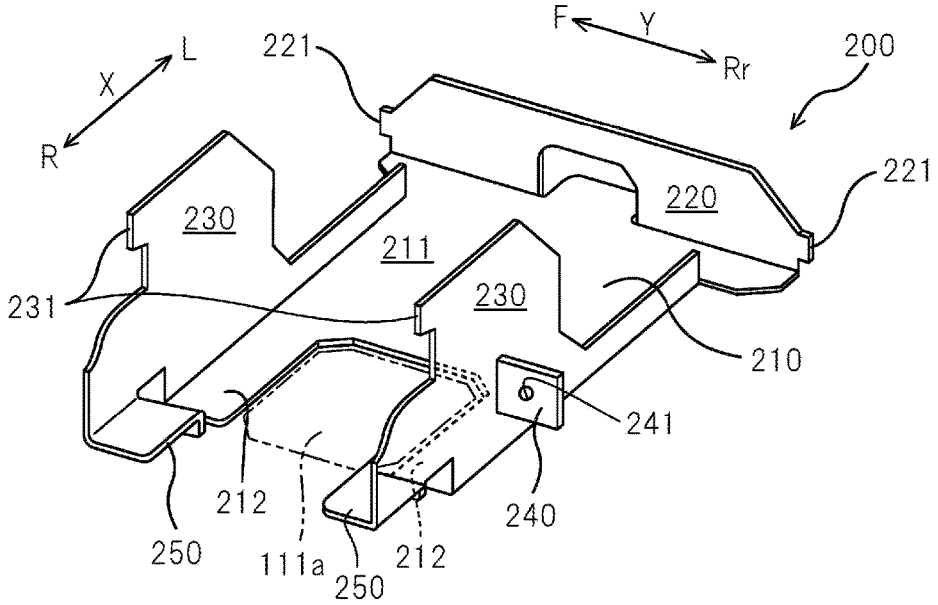
FIG. 18 is a perspective view of a support member of the waste ink mechanism shown in FIG. 12.

FIG. 18 is a perspective view of the support member 200. In FIG. 18, the left-right direction X is opposite to that in FIG. 12. The support member 200 includes a bottom wall 210, a left wall 220, a pair of side walls 230, stepped portions 250, and a suspending portion 240. The bottom wall 210 extends perpendicular or substantially perpendicular to the left wall 310, the right wall 320 and the side walls 330 of the securing member 300. The bottom wall 210 extends parallel or substantially parallel to the XY plane of the second attachment portion 350. The left wall 220 and the side walls 230 extend upward from the bottom wall 210. The left wall 220 extends parallel to the left wall 310 of the securing member 300 along the left wall 310. The pair of side walls 230 are located to face each other in the front-rear direction Y. The pair of side walls 230 extend parallel or substantially parallel to the side walls 330 of the securing member 300 along the side walls 330.

The bottom wall 210 includes a left bottom wall 211 and a pair of right bottom walls 212. The left bottom wall 211 is a left portion of the bottom wall 210. The left bottom wall 211 connects a bottom end of the front side wall 230 and a bottom end of the rear side wall 230 to each other. The pair of right bottom walls 212 are in a right portion of the bottom wall 210. The pair of right bottom walls 212 are spaced away from each other in the front-rear direction Y. The front right bottom wall 212 extends rearward from the bottom end of the front side wall 230. The rear right bottom wall 212 extends forward from the bottom end of the rear side wall 230. A neck portion 111 of the waste ink tank 110 is attached between the pair of right bottom walls 212. The waste ink tank 110 is supported by top surfaces of the pair of right bottom walls 212.

Protruding portions 221 are provided respectively at a front end and a rear end of the left wall 220. The front protruding portion 221 extends forward. The rear protruding portion 221 extends rearward. The two protruding portions 221 are respectively slidably inserted into the two receiving holes 331 in the side walls 330 of the securing member 300, and thus the securing member 300 and the support member 200 are coupled with each other. The support member 200 is structured such that a right portion thereof is inclinable downward about the protruding portions 221 acting as the support. Specifically, the support member 200 is structured to be displaced from a horizontal position, at which the right portion and a left portion thereof are at the same height level, to an inclined position, at which the right portion is located below the left portion. With such a structure, a portion of the support member 200 is moved downward with higher precision than in the case where, for example, the entirety of the support member 200 is moved downward. In addition, such a structure simplifies the structure of the printer 90 and thus further decreases the production cost of the printer 90. With the above-described structure of the support member 200, for example, it is not necessary to move the entirety of the support member 200 downward, and thus it is not necessary to make uniform the moving distance in the left-right direction X. Therefore, it is not necessary to provide a plurality of first loading springs or to adjust the positions thereof. This also simplifies the structure.

At right ends of the pair of side walls 230, protruding portions 231 protruding rightward are provided. The two protruding portions 231 are at a level higher than that of the two protruding portions 221. The two protruding portions 231 are slidably inserted into the receiving holes 321 in the right wall 320 of the securing member 300, and thus the securing member 300 and the support member 200 are coupled with each other. When the support member 200 is inclined to have a large angle with respect to the horizontal direction, the protruding portions 231 contact the securing member 300. Therefore, the range of inclination of the support member 200 is restricted, and thus the support member 200 is not excessively inclined. With such a structure, the waste ink tank 110 attached to the support member 200 is held stably.

The stepped portions 250 are respectively provided at right ends of the pair of right bottom walls 212. The stepped portions 250 are at a higher level in the up-down direction Z than that of the bottom wall 210. The stepped portions 250 act as stoppers that support the neck portion 111 of the waste ink tank 110 on the right side and stably hold the waste ink tank 110. In the case where, for example, the support member 200 is inclined or the waste ink tank 110 is attached in an inclined state, the neck portion 111 of the waste ink tank 110 contacts the stepped portions 250. Thus, the waste ink tank 110 is held stably.

The suspending portion 240 is provided on the rear side wall 230. The suspending portion 240 is located to the right of the center, in the left-right direction X, of the rear side wall 230. The suspending portion 240 extends rearward from the rear side wall 230. An attachment hole 241 is provided in the suspending portion 240. A bottom end of the second loading spring 140 is attached to the attachment hole 241. With such a structure, the support member 200 is suspended by the securing member 300 via the second loading spring 140.

The second loading spring 140 is located along the up-down direction Z. As described above, the top end of the second loading spring 140 is attached to the position adjusting member 500, and the bottom end of the second loading spring 140 is attached to the support member 200. The second loading spring 140 loads the right portion of the support member 200 toward the position adjusting member 500 (toward the securing member 300, upward). The second loading spring 140 may be any spring that loads the support member 200 upward. The second loading spring 140 is, for example, a coil spring. The second loading spring 140 may be made of, for example, an elastic material such as rubber or the like. The second loading spring 140 may have an elastic force adjusted to be well balanced with a sum of the weights of the support member 200, the shutter member 400 and the waste ink tank 110 and the weight of the waste ink accommodated in the waste ink tank 110 in a full state. The second loading spring 140 is an example of a second energizing member.

The shutter member 400 is attached to the support member 200. The shutter member 400 includes a bottom wall 410, a left wall 420 (see FIG. 13), a right wall 430 and a pair of side walls 440. The bottom wall 410 extends along the bottom wall 210 of the support member 200. The left wall 420 and the right wall 430 are located to face each other in the left-right direction X. The left wall 420 extends upward from a left end of the bottom wall 410. The right wall 430 extends upward from a right end of the bottom wall 410. The pair of side walls 440 are located to face each other in the front-rear direction Y. The pair of side walls 440 respectively extend upward from a front end and a rear end of the bottom wall 410. A left end of the first loading spring 150 is attached to the left wall 420. The detection target 130 is attached to a left surface of the right wall 430. A right surface of the right wall 430 contacts the waste ink tank 110 when the waste ink tank 110 is supported by the support member 200. The right wall 430 is an example of a wall that contacts the waste ink tank 110 when the waste ink tank 110 is supported by the support member 200. In the attached state, the right wall 430 is pushed leftward by the waste ink tank 110.

A slide hole 450 is provided in the bottom wall 410. The slide hole 450 extends in the left-right direction X. A bolt 460 is inserted into the slide hole 450. The bolt 460 is slidable in the left-right direction X along the slide hole 450. With such a structure, the shutter member 400 is attached to the support member 200 so as to be slidable in the left-right direction X. When the support member 200 is inclined with respect to the securing member 300, the shutter member 400 is inclined together with the support member 200. The shutter member 400 is an example of a displaceable member.

The first loading spring 150 is located along the left-right direction X. As described above, the left end of the first loading spring 150 is attached to the left wall 420 of the shutter member 400. The right end of the first loading spring 150 is attached to the second attachment portion 350 of the securing member 300. The first loading spring 150 loads the shutter member 400 rightward. Namely, the first loading spring 150 loads the shutter member 400 in a direction in which the shutter member 400 approaches the outlet opening 162 of the funnel 160. The first loading spring 150 may be any spring that loads the shutter member 400 toward the outlet opening 162. The first loading spring 150 is, for example, a coil spring. The first loading spring 150 may be formed of, for example, an elastic material such as rubber or the like. The first loading spring 150 expands leftward as the shutter member 400 slides leftward. The first loading spring 150 is an example of a first energizing member.

As shown in FIG. 14, in the unattached state, the shutter member 400 is located directly below the outlet opening 162 of the funnel 160. Namely, in the unattached state, the outlet opening 162 of the funnel 160 and the bottom wall 140 of the shutter member 400 overlap each other as seen in a plan view. In the unattached state, the bottom wall 410 acts as an ink receiving portion. The bottom wall 410 is an example of an ink receiving portion. The ink receiving portion merely needs to include a portion of the bottom wall 410 that overlaps the outlet opening 162 of the funnel 160 as seen in a plan view, but may include the bottom wall 410, the left wall 420, the right wall 430 and the pair of side walls 440. An ink-absorbing pad or the like may be placed on the bottom wall 410 like in preferred embodiment 1. The ink receiving portion receives the ink dripping from the outlet opening 162 of the funnel 160 to prevent the ink from leaking to an area around the printer 90. The ink receiving portion is an example of a liquid receiving portion.

As shown in FIG. 13, when the waste ink tank 110 is supported by the support member 200, the shutter member 400 is pushed leftward by the waste ink tank 110 and slides leftward along the slide hole 450. At this point, the shutter member 400 slides on a top surface of the bottom wall 210 of the support member 200. The shutter member 400 is displaced from a right position, at which the bottom wall 410 is located relatively right, to a left position, at which the bottom wall 410 is located relatively left.

The detection member 120 is attached to the first attachment portion 340 of the securing member 300. The detection member 120 is a light-transmissive photosensor, like in preferred embodiment 1. The detection member 120 includes a light emitter 121 and a light receiver 122 located to face the light emitter 121. The light emitter 121 and the light receiver 122 are electrically connected with the controller 96. The detection member 120 is an example of a sensor.

The detection target 130 is attached to the left surface of the right wall 430 of the shutter member 400. The detection target 130 is a plate-shaped member. The detection target 130 has a trapezoidal shape with a left bottom portion being cut off as seen in a side view. In this preferred embodiment, the shutter member 400 is displaced in the left-right direction X and the up-down direction Z in accordance with the state of the waste ink tank 110. Along with the displacement of the shutter member 400, the position of the detection target 130 is changed. Therefore, the position of the detection target 130 with respect to the detection member 120 is changed. The detection target 130 is an example of a detection target. An assembly of the detection member 120 and the detection target 130 is an example of a detector that detects whether or not the waste ink tank 110 is attached and also whether or not the waste ink tank 110 is full.

Figure 19:
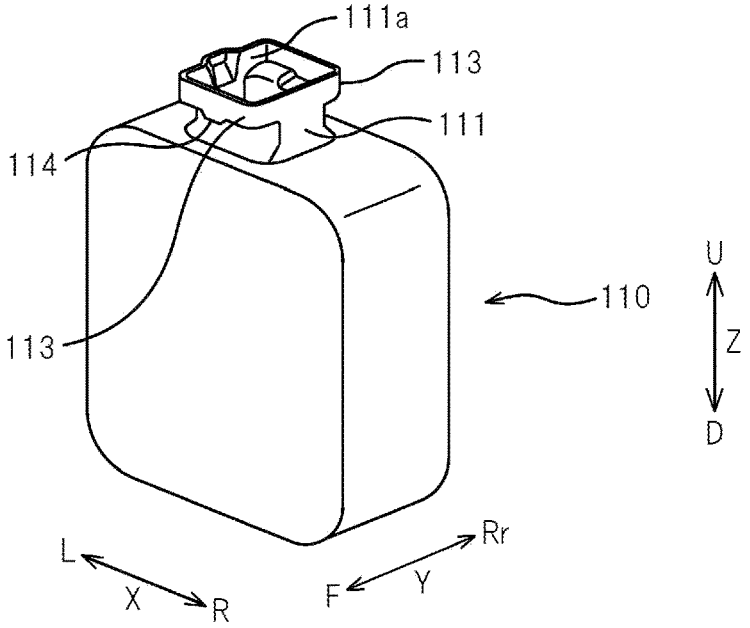
FIG. 19 is a perspective view of the waste ink tank of the waste ink mechanism shown in FIG. 12.

FIG. 19 is a perspective view of the waste ink tank 110. The waste ink tank 110 is a container storing the collected waste ink. The material, the shape and the like of the waste ink tank 110 may be the same as those of the waste ink tank 43 in preferred embodiment 1. The waste ink tank 110 includes the neck portion 111. An upward opening 111*a* is provided in the neck portion 111. The opening 111*a* has an area size larger than an area size of the outlet opening 162 of the funnel 160 as seen in a plan view. As seen in a side view, the neck portion 111 is generally T-shaped. The neck portion 111 includes a pair of top protruding portions 113 protruding in the front-rear direction Y. The protruding portions 113 each include a protruding portion 114 protruding downward. The protruding portion 114 is located above the center of gravity of the waste ink tank 110.

Figure 20:
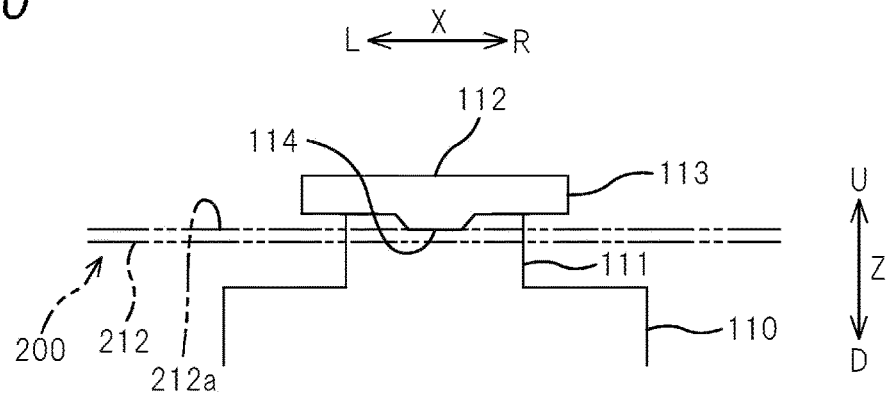
FIG. 20 is a side view of the waste ink tank before the support member is inclined.
Figure 21:
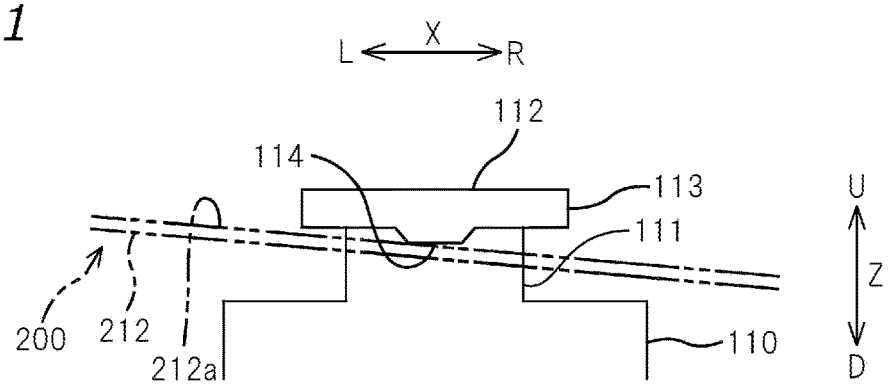
FIG. 21 is a side view of the waste ink tank after the support member is inclined.

As shown in FIG. 20, in a state where the waste ink tank 110 has a remaining capacity, the support member 200 is at the horizontal position, at which the right portion and the left portion are at the same height level. The waste ink tank 110 is supported by the support member 200 by the right bottom walls 212 of the support member 200 contacting the protruding portions 114. The opening 111*a* of the waste ink tank 110 is generally horizontal. As shown in FIG. 21, when the waste ink tank 110 becomes full with the collected waste ink, the support member 200 is displaced to the inclined position, at which the right portion of the support member 200 is located below the left portion. In the waste ink tank 110, the protruding portions 114 are located above the center of gravity of the waste ink tank 110. Therefore, when the support member 200 is displaced to the inclined position, the waste ink tank 110 is swung about the protruding portions 114 acting as the support. As a result, the waste ink tank 110 is kept at a posture at which the opening 111*a* is generally horizontal even though the support member 200 is at the inclined position. Therefore, the waste ink tank 110 is prevented from being inclined, and thus the waste ink is prevented from leaking from the waste ink tank 110.

The controller 96 controls operations of various components of the printer 90. The controller 90 may have, for example, substantially the same structure as that of the controller 50 in preferred embodiment 1. As shown in FIG. 10, the controller 90 is configured or programmed to include a main controller 961, a determiner 962, a printing start controller 963, a notifier 964, and an operation interrupter 965.

The main controller 961 controls the printing operation and the cleaning operation. The main controller 961 is communicably connected with the carriage motor and a feed motor, and controls the positional relationship between the printing target 92 and the ink head 93. The main controller 961 is communicably connected with the ink head 93, and controls the injection of the ink toward the printing target 92 or a flushing box. The main controller 961 is communicably connected with the light emitter 121, and controls the output of the light from the light emitter 121. The main controller 961 is communicably connected with the liquid supply pump 94, and controls the supply of the waste ink to the waste ink tank 110.

The determiner 962 is communicably connected with the light receiver 122. An amount of received light is input to the determiner 962 from the light receiver 122. Like the second determiner 53 in preferred embodiment 1, the determiner 962 determines whether the detection target 130 is in a state of being detectable (detectable state) or in a state of not being detectable (nondetectable state), based on the amount of received light. The determiner 962 determines whether or not the waste ink tank 110 is attached while still having a remaining capacity, namely, whether or not the printer 90 is in a state of capable of performing printing. The determiner 962 may be structured to determine whether or not the waste ink mechanism 100 is in the unattached state and whether or not the waste ink tank 110 is full, based on a timewise change in the amount of received light. When, for example, the amount of received light is gradually increased as the printing operation advances and becomes generally equal to the amount of light output from the light emitter 121 (amount of output light), the determiner 962 may determine that the waste ink tank 110 is full. In any of the other states, the determiner 962 may determine that the waste ink mechanism 100 is in the unattached state. When, for example, the amount of received light that is generally zero becomes generally equal to the amount of light output from the light emitter 121 (amount of output light) instantaneously (typically within several seconds to several ten seconds, for example, within 5 seconds), the determiner 962 may determine that the waste ink mechanism 100 is in the unattached state, in which the waste ink tank 110 is detached.

The printing start controller 963 is configured or programmed to control whether or not to release the printer 90 from the stop state, based on the determination results of the determiner 926. When, for example, the determiner 926 determines that the detection target 130 is in the detectable state, the printing start controller 963 releases the printer 90 from the stop state. By contrast, when the determiner 962 determines that the detection target 130 is in the nondetectable state, the printing start controller 963 does not release the printer 90 from the stop state. The printing start controller 963 may have, for example, substantially the same structure as that of the printing start controller 54 in preferred embodiment 1. The notifier 964 is structured to notify the user of an error based on the determination results of the determiner 962. The notifier 964 may have, for example, substantially the same structure as that of the notifier 55 in preferred embodiment 1.

The operation interrupter 965 is structured to, when the determiner 962 determines that the detection target 130 is in the nondetectable state, interrupt the printing operation or the cleaning operation to stop collecting the waste ink for a while. The operation interrupter 965 may be structured to, for example, stop the injection of the ink from the ink head 93 or to stop the driving of the liquid supply pump 94. With such a structure, if the waste ink tank 110 is inadvertently detached, or when the waste ink tank 110 becomes full, the collection of the waste ink is interrupted. Therefore, the waste ink is prevented from being scattered in an area around the printer 90 (e.g., on the floor surface) to stain the environment around the user.

Hereinafter, an operation of the waste ink mechanism 100 will be described. As shown in FIG. 14, in the unattached state, the right portion of the support member 200 is pushed upward by the elastic force of the second loading spring 140. Therefore, the support member 200 and the shutter member 400 are suspended by the securing member 300 in a generally horizontal state. Namely, the shutter member 400 is at the horizontal state. The shutter member 400 is located at the right position by the elastic force of the first loading spring 150. The state where the shutter member 400 is at the horizontal position and at the right position is an example of a second position. When the shutter member 400 is at the second position, the bottom wall 410 of the shutter member 400 is directly below the outlet opening 162 of the funnel 160. The shutter member 400 acts as the ink receiving portion that receives the ink dripping from the funnel 160.

When the shutter member 400 is at the second position, the detection target 130 overlaps the right bottom walls 212 of the support member 200 as seen in a plan view. The detection target 130 is located below the funnel 160. The detection target 130 is located to the right of the detection member 120. The detection target 130 is not located between the light emitter 121 and the light receiver 122. The detection target 130 is displaced to a second detection position. The detection target 130 is at such a position that is undetectable by the detection member 120. Therefore, the light output from the light emitter 121 reaches the light receiver 122 without being blocked by the detection target 130. The amount of light received by the light receiver 122 (amount of received light) is input to the controller 96. Based on the amount of received light, the controller 96 detects that the detection target 130 is in a state of not being detectable (undetectable state).

The waste ink tank 110 is attached by, for example, the user. The user inserts the neck portion 111 of the waste ink tank 110 having a remaining capacity (e.g., empty waste ink tank 110) into a space between the pair of right bottom walls 212 of the support member 200. As a result, the neck portion 111 of the waste ink tank 110 is supported by the top surfaces of the right bottom walls 212 of the support member, left surfaces of the stepped portion and the right surface of the right wall 430. The waste ink tank 110 is attached such that the opening 111*a* faces the outlet opening 162 of the funnel 160. As described above, the neck portion 111 of the waste ink tank 110 is inserted into the space between the pair of right bottom walls 212 of the support member 200. With such a structure, the shutter member 400 moves toward the left wall 310 of the securing member 300 (leftward in FIG. 14), and the detection target 130 attached to the right wall 430 of the shutter member 400 enters the opening 352 extending through the left portion of the second attachment portion 350 and thus is located between the light emitter 121 and the light receiver 122 of the detection member 120.

As shown in FIG. 13, even when the waste ink tank 110 having a remaining capacity is attached, the support member 200 and the shutter member 400 are kept in the generally horizontal state by the elastic force of the second loading spring 140. Namely, the shutter member 400 is at the horizontal position. When the waste ink tank 110 is attached, the support member 200 is pushed by the waste ink tank 110 to slide leftward against the elastic force of the first loading paring 150. Therefore, the shutter member 400 moves from the right position to the left position. The shutter member 400 slides to a position not facing the outlet opening 162 of the funnel 160. Along with this, the detection target 130 also slides leftward. The state in which the shutter member 400 is at the horizontal position and at the left position is an example of a first position.

In the state where the shutter member 400 is at the first position, the detection target 130 overlaps the left bottom wall 211 of the support member 200 as seen in a plan view. The detection target 130 is located between the light emitter 121 and the light receiver 122 of the detection member 120. The detection target 130 is displaced to a first detection position. The detection target 130 is at a position detectable by the detection member 120. Therefore, the light output from the light emitter 121 is blocked by the detection target 130 and does not reach the light receiver 122. As a result, the amount of light received by the light receiver 122 is decreased. For example, the amount of light received by the light receiver 122 becomes zero. Based on the amount of such received light, the controller 96 detects that the detection target 130 is in a state of being detectable (detectable state).

As shown in FIG. 15, the cleaning operation is repeated, and thus the waste ink is gradually accumulated in the waste ink tank 110. Then, the right portion of the support member 200 is gradually pushed downward against the elastic force of the second loading spring 140. Specifically, the support member 200 is gradually inclined downward about the protruding portions 221 acting as the support by the weight of the waste ink. The support member 200 and the shutter member 400 are gradually displaced from the horizontal position to the inclined position. The support member 200 is gradually inclined by the weight of the waste ink. This prevents the waste ink from splashing as a reaction to rapid inclination of the support member 200. Along with the gradual inclination of the support member 200, the detection target 130 gradually moves downward. The state where the shutter member 400 is at the inclined position and at the left position is an example of a third position.

When the waste ink tank 110 becomes full as a result of a predetermined amount of waste ink being collected therein, the shutter member 400 is at the third position. At this point, the detection target 130 is out of the area between the light emitter 121 and the light receiver 122. The detection target 130 is located below the detection member 120. The detection target 130 is at a position not detectable by the detection member 120. Therefore, the light output from the light emitter 121 reaches the light receiver 122 without being blocked by the detection target 130. Based on the amount of received light, the controller 96 detects that the detection target 130 is in a state of not being detectable (undetectable state).

When the user detaches the waste ink tank 110 in the full state from the support member 200, the waste ink mechanism 100 is returned to the unattached state (FIG. 14). Namely, the support member 200 and the shutter member 400 are returned to the horizontal position by the elastic force of the second loading spring 140. The shutter member 400 automatically moves rightward to return to the right position by the elastic force of the first loading spring 150. The shutter member 400 moves to the second position, namely, directly below the outlet opening 162 of the funnel 160. Along with this movement, the detection target 130 returns to the position below the funnel 160.

In the printer 90 in preferred embodiment 3, the right side cover 90R is provided with the support member 200, which supports the shutter member 400 such that the shutter member 400 is slidable and to which the waste ink tank 110 is detachably attached. With such a structure, a sliding mechanism moving the shutter member 400 leftward is made unnecessary. Therefore, the structure of the printer 90 is more simplified.

The printer 90 in preferred embodiment 3 further includes the first loading spring 150 including one end attached to the shutter member 400 and another end directly or indirectly attached to the right side cover 90R and loading the shutter member 400 rightward, namely, in a direction in which the bottom wall 410 approaches the outlet opening 162 of the funnel 160. The shutter member 400 is structured to, in a state where the waste ink tank 110 is not attached to the right side cover 90R, be kept at the position at which the bottom wall 410 is directly below the outlet opening 162 of the funnel 160. The shutter member 400 is kept at such a position by the loading force of the first loading spring 150. The shutter member 400 automatically returns to the position directly below the outlet opening 162 of the funnel 160. This alleviates the working load on the user as compared with the case where, for example, the user manually closes the shutter member 400. In addition, a situation is prevented in which the user forgets to close the shutter member 400 to cause the waste ink to drip from the funnel 160 and thus to stain the area around the printer 90.

In the printer 90 in preferred embodiment 3, the shutter member 400 is structured to be displaced to the third position when a predetermined amount of waste ink is collected in the waste ink tank 110 attached to the support member 200. The detection target 130 is structured to move to a third detection position when the shutter member 400 moves the third position. When the detection target 130 is at the third detection position, the controller 96 determines that the predetermined amount of waste ink is collected in the waste ink tank 110 based on the detection results of the detection member 120. In the printer 90, the shutter member 400 is displaced to any one of three positions, more specifically, first through third positions. It may be determined whether the waste ink tank 110 is present or absent (whether or not the waste ink tank 110 is attached) and also whether or not the waste ink tank 110 is to be replaced (whether or not the waste ink tank 110 is full) by a set of the detection member 120 and the detection target 130. In other words, it may be determined whether or not the printer 90 is capable of performing printing with the waste ink tank 110 having a remaining capacity being attached to the waste ink mechanism 100. Therefore, the cost is decreased as compared with the case where, for example, as in preferred embodiment 1, a sensor that detects whether the waste ink tank is present or absent and a sensor that detects whether or not the waste ink tank is to be replaced are separately provided.

In the printer 90 in preferred embodiment 3, the right side cover 90R is provided with the securing member 300, which supports the support member 200 such that at least a portion of the support member 200 is displaceable in the up-down direction Z. The printer 90 further includes the second loading spring 140 including the bottom end attached to the support member 200 and the top end directly or indirectly attached to the right side cover 90R and loading the support member 200 upward. The shutter member 400 is structured to, when a predetermined amount of waste ink is collected in the waste ink tank 110, be displaced from the first position to the third position against the loading force of the second loading spring 140, as a result of at least a portion of the support member 200 moving downward. With such a structure, it may be determined whether or not the waste ink tank 110 is full with higher precision than in the case where, for example, it is presumed whether or not a predetermined amount of waste ink is collected based on the injection of the ink from the ink head 93, based on the rotation rate of the liquid supply pump 94, or the like. The shutter member 400 and the support member 200 supporting the shutter member 400 are gradually displaced from the horizontal position to the inclined position by the weight of the waste ink. Therefore, the support member 200 is not inclined rapidly. This prevents the waste ink from splashing as a reaction to the inclination of the support member 200.

In the printer 90 in preferred embodiment 3, the right side cover 90R is provided with the position adjusting member 500, which is attached to the securing member 300 so as to be positionally adjusted in the up-down direction Z with respect to the securing member 300 and to which the top end of the second loading spring 140 is attached. The detection member 120 is attached to the securing member 300. With such a structure, the position of the detection member 120 is easily fine-tuned in accordance with, for example, the difference in the elastic force among springs each used as the second loading spring 140. Specifically, the positional relationship between the detection member 120 and the detection target 130 in the up-down direction Z is fine-tuned. Therefore, the detection target 130 may be properly detected by the detection member 120 regardless of the individual difference among the springs each used as the second loading spring 140.

In the printer 90 in preferred embodiment 3, the cleaning mechanism 97 is provided with the liquid supply pump 94 supplying a liquid toward the waste ink path 95. The controller 96 includes the operation interrupter 965, which stops the driving of the liquid supply pump 94 when the shutter member 400 is at the second position or the third position. With such a structure, if the user inadvertently detaches the waste ink tank 110, or when the waste ink tank 110 becomes full, while the waste ink is being recovered, the collection of the waste ink is interrupted. Therefore, a situation is prevented in which the waste ink is not received by the waste ink tank 110 or the waste ink tank 110 is overflown with the waste ink. As a result, the waste ink is prevented from being scattered in an area around the printer 90 (e.g., on the floor surface around the printer 90) to stain the environment around the user.

The inkjet printer 90 in preferred embodiment 3 is described above. The inkjet printer according to the present invention is not limited to the above.

For example, in preferred embodiment 3 described above, the controller 96 is structured to drive the liquid supply pump 94 to supply the waste ink to the waste ink mechanism 100. The present invention is not limited to this. The waste ink mechanism 100 may be, for example, communicably connected with a second controller different from the controller 96, and the second controller may be structured to control the liquid supply pump 94 such that the liquid supply pump 94 is driven or stopped.

For example, in preferred embodiment 3 described above, the support member 200 is supported by the securing member 300 so as to be inclined, more specifically, so as to be inclined by the weight of the waste ink collected in the waste ink tank 110. The present invention is not limited to this. For example, the support member 200 may be structured to move downward by the weight of the waste ink while being kept in the horizontal state. In this case, the second loading springs 140 extending in the up-down direction may be provided before and behind the support member 200. Alternatively, a guide may be provided such that the support member 200 moves in the up-down direction Z while being kept in the horizontal state.

For example, in preferred embodiment 3 described above, the detection member 120 includes the light emitter 121 and the light receiver 122 located to face the light emitter 121. The present invention is not limited to this. The detection member 120 may be, for example, a sensor in which the light emitter 121 and the light receiver 122 are located on the same side instead of facing each other, a contact sensor that detects that the detection target 130 contacts the sensor, or the like. Like in preferred embodiment 1, there are two or more detection members 120. For example, in preferred embodiment 3 described above, the detection target 130 is in the detectable state when the waste ink tank 110 having a remaining capacity is attached in the printer 90, and is in the undetectable state when the waste ink tank 110 is not attached or when the waste ink tank 110 is full. The detectable state and the undetectable state may be opposite to the above.

The position adjusting member 500, the second loading spring 140 and the first loading spring 150 are not indispensable and may be omitted. At least one of these components may be excluded from the waste ink mechanism 100.

Preferred Embodiment 4

Figure 22:
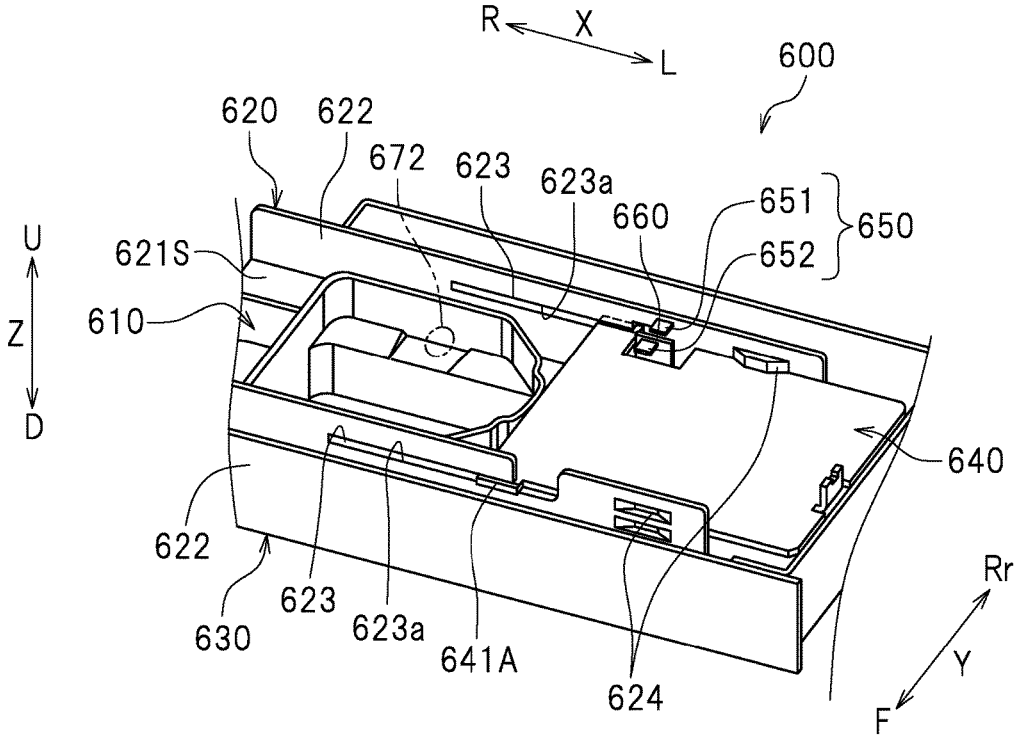
FIG. 22 is a partial perspective view of a waste ink mechanism in preferred embodiment 4 according to the present invention.
Figure 23:
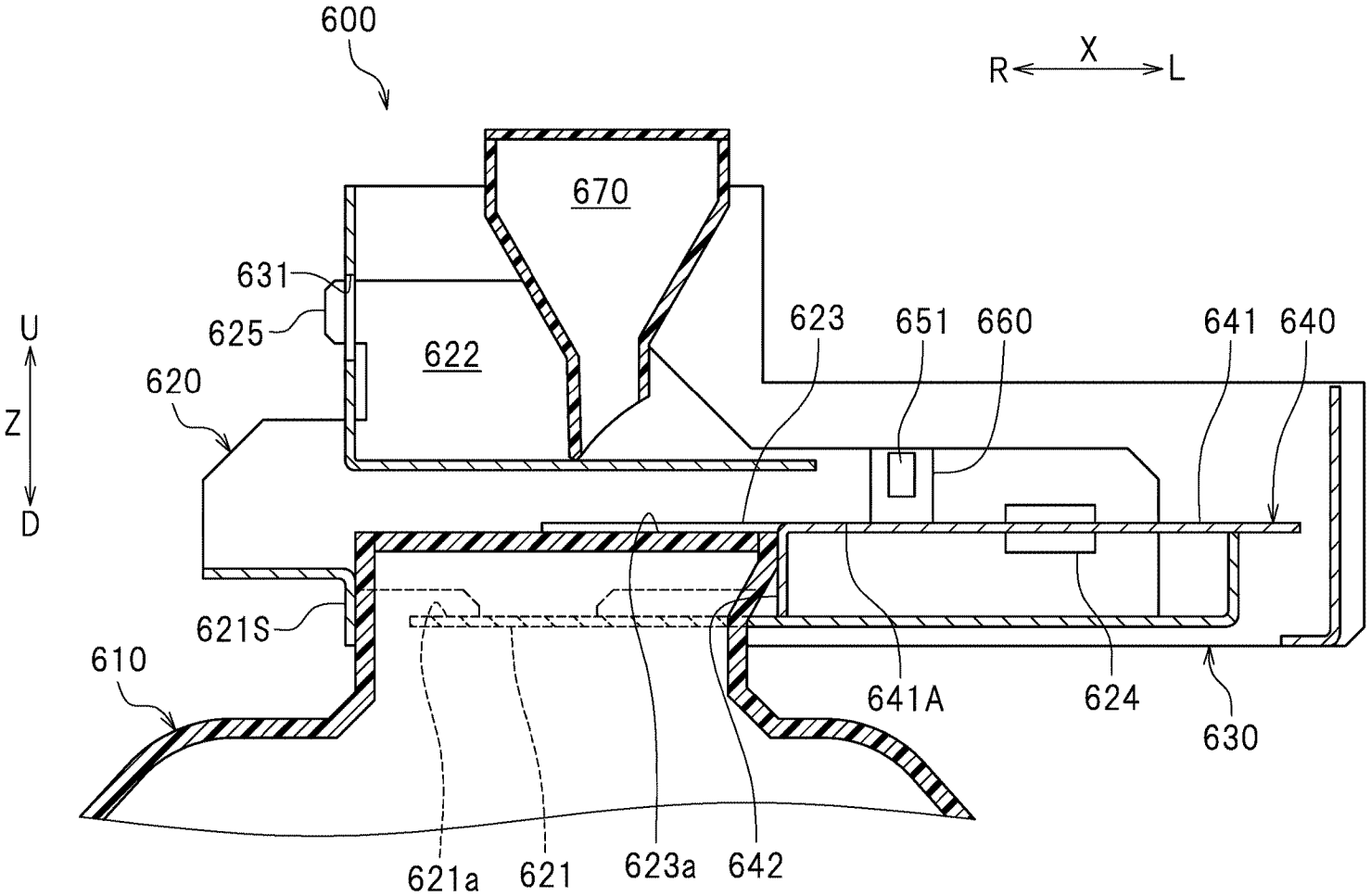
FIG. 23 is a schematic cross-sectional view of the waste ink mechanism in preferred embodiment 4 according to the present invention.
Figure 24:
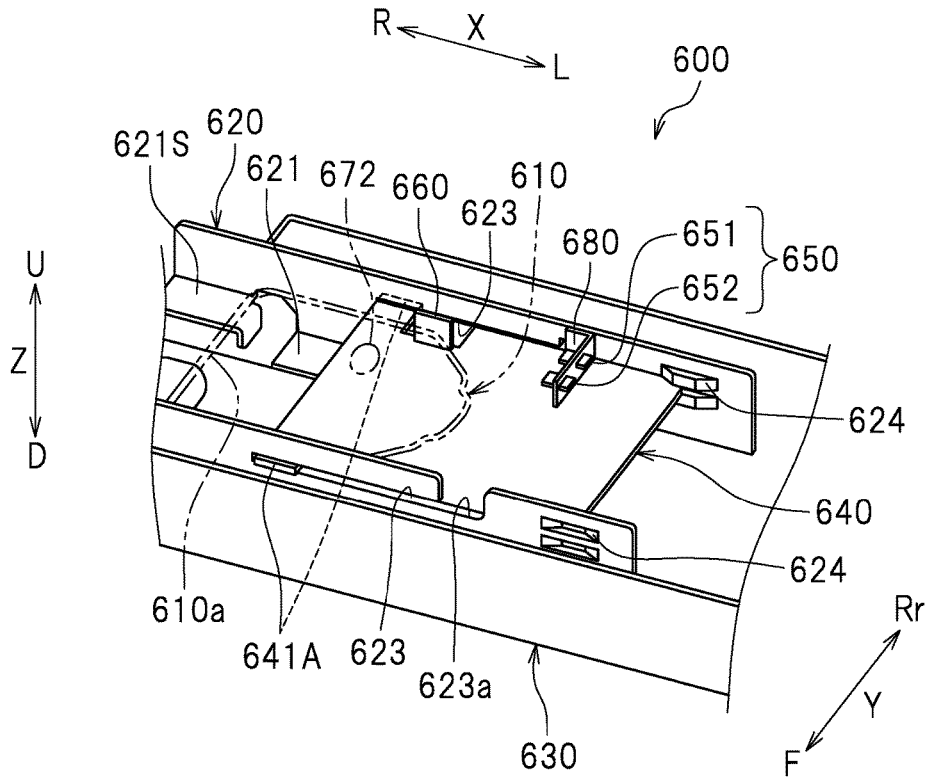
FIG. 24 is a partial perspective view of the waste ink mechanism shown in FIG. 22 in a state where no waste ink tank is attached.
Figure 25:
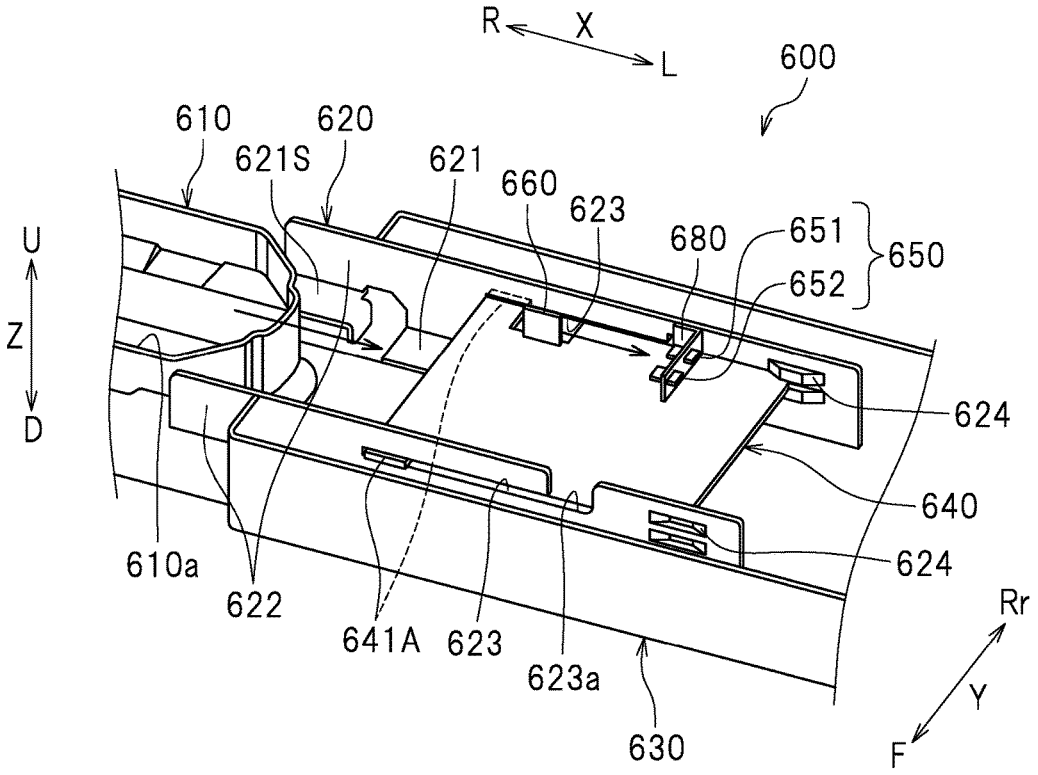
FIG. 25 is a partial perspective view showing how the waste ink tank is attached to the waste ink mechanism shown in FIG. 22.

FIG. 22 is a partial perspective view of a waste ink mechanism 600. FIG. 23 is a schematic cross-sectional view of the waste ink mechanism 600. FIG. 22 and FIG. 23 show a state where a waste ink tank 610 having a remaining capacity is attached to the waste ink mechanism 600 (attached state). FIG. 22 omits a funnel 670 described below and top portions of a pair of side walls 622 described below. FIG. 24 is a partial perspective view of the waste ink mechanism 600 in a state where the waste ink tank 610 is not attached (unattached state). FIG. 25 is a partial perspective view showing how the waste ink tank 610 is attached to the waste ink mechanism 600. Letters representing the directions in FIG. 22 through FIG. 25 represent the same directions as in preferred embodiments 1 through 3. Hereinafter, differences from preferred embodiment 3 will be mainly described.

The waste ink mechanism 600 includes a securing member 630, a support member 620, the waste ink tank 610, the funnel 670, a shutter member 640, a detection member 650, and a detection target 660. The waste ink mechanism 600 may be the same as the waste ink mechanism 100 in preferred embodiment 3 except for the structures of the shutter member 640 and the support member 620 securing the shutter member 640 and the positions of the detection member 650 and the detection target 660. The waste ink mechanism 600 may further include the position adjusting member 500, the second loading spring 140 and the first loading spring 150 in preferred embodiment 3.

Like in preferred embodiment 3, the securing member 630 is attached to the right side cover 90R of the printer 90. Receiving holes 631 are provided in the securing member 630. Like in preferred embodiment 3, the support member 620 is attached to the securing member 630. The support member 620 includes a bottom wall 621 and the pair of side walls 622. Like in preferred embodiment 3, the waste ink tank 610 is supported by a top surface (support surface) 621*a* of the bottom wall 621 and a left surface of each of stepped portions 621S.

The pair of side walls 622 are located to face each other in the front-rear direction Y. The pair of side walls 622 respectively extend upward from a front end and a rear end of the bottom wall 621. At right ends of the pair of side walls 622, protruding portions 625 protruding rightward are provided. The protruding portions 625 are inserted into the receiving holes 631. Unlike in preferred embodiment 3, a cutout groove 623 is provided in each of the pair of side walls 622, and a holding portion 624 are provided on each of the pair of side walls 622. The cutout grooves 623 are provided above the bottom wall 621. In more detail, the cutout grooves 623 are provided above the top surface (support surface) 621*a* of the bottom surface 621, on which the waste ink tank 610 is supported. The cutout grooves 623 extend in the left-right direction X. Two protruding portions 641A of the shutter member 640 described below are respectively inserted into the cutout grooves 623. The holding portions 624 are located to the left of the cutout grooves 623. The cutout grooves 623 and the holding portions 624 are located at the same height level. The holding portions 624 support a slidable portion 641 of the shutter member 640 described below such that the slidable portion 641 is slidable. The holding portions 624 each include a top portion and a bottom portion located in series in the up-down direction Z. The top portion and the bottom portion protrude inward (toward the side on which the top portion and the bottom portion contact the slidable portion 641). A central portion of each of the holding portions 640 in the up-down direction Z is recessed.

The shutter member 640 is attached to the support member 620. Unlike in preferred embodiment 3, the shutter member 640 includes the slidable portion 641 and a right wall 642. The slidable portion 641 is flat and plate-shaped as seen in a plan view. The slidable portion 641 extends parallel or substantially parallel to the bottom wall 621 of the support member 620. The slidable portion 641 is located above the bottom wall 621. At a right end of the slidable portion 641, the two protruding portions 641A are provided. The two protruding portions 641A protrude forward and rearward, in other words, toward the cutout grooves 623 of the support member 620, from the slidable portion 641. The protruding portions 641A are inserted into the cutout grooves 623 of the support member 620. The slidable portion 641 moves along bottom surfaces (moving surfaces) 623*a* of the cutout grooves 623. The slidable portion 641 is supported by the support member 620 so as to be slidable in the left-right direction X. In the attached state, the slidable portion 641 is located to the left of the waste ink tank 610. In the attached state, the shutter member 640 is located at the left position, like in preferred embodiment 3.

The right wall 642 extends downward from a right end of the slidable portion 641. A bottom end of the right wall 642 is in contact with the bottom wall 621. In the attached state, the right wall 642 contacts the waste ink tank 610. The right wall 642 is an example of a wall that contacts the waste ink tank 610 when the waste ink tank 610 is supported by the support member 620. In the attached state, an outlet opening 672 of the funnel 670 is located just above an opening 610*a* of the waste ink tank 610.

The detection member 650 is attached to the rear side wall 622 of the support member 620 via a bracket 680 (see FIG. 24). The detection member 650 includes a light emitter 651 and a light receiver 652. The detection target 660 stands as extending upward from the slidable portion 641. The slidable portion 641 slides in the left-right direction X, and thus the detection target 660 is displaced in a direction toward the detection member 650 or in a direction distanced from the detection member 650.

In preferred embodiment 3, the bolt 460 is provided to be slidable in the left-right direction X along the slide hole 450. With such a structure, the shutter member 400 is slidable in the left-right direction X with respect to the support member 200. In preferred embodiment 4, the slidable portion 641 of the shutter member 640 is slidably supported by the holding portions 642 provided on the pair of side walls 622. In preferred embodiment 3, the detection target 130 is attached to the left surface of the right wall 430 of the shutter member 400. In preferred embodiment 4, a portion of the slidable portion 641 that is a portion that receives the waste ink leaking from the outlet opening 672 of the funnel 670 is bent, and the detection target 660 stands to extend upward.

As shown in FIG. 24, in the unattached state, like in preferred embodiment 3, the shutter member 640 is located at the right position. The slidable portion 641 of the shutter member 640 is located directly below the outlet opening 672 of the funnel 670. The detection target 660 is located at a position not detectable by the detection member 650. The slidable portion 641 acts as an ink receiving portion. As shown in FIG. 25, in order to attach the waste ink tank 610, the user inserts the waste ink tank 610 into the support member 620 from the right side of the shutter member 640. As a result, when the waste ink tank 610 is attached to the support member 620, the right wall 642 of the shutter member 640 is pushed leftward by the waste ink tank 610. Then, the slidable portion 641 of the shutter member 640 slides leftward along the cutout grooves 623 of the support member 620. The shutter member 640 is displaced from the right position to the left position. Along with this displacement, the detection target 660 slides leftward. In this manner, the detection target 660 moves to a position detectable by the detection member 650.

In the printer 90 in preferred embodiment 4, the support member 620 includes the support surface 621*a* supporting the waste ink tank 610 and a slide support surface (moving surface) 623*a* located above the support surface 621*a* and supporting the shutter member 640 such that the shutter member 640 is slidable. The support surface 621*a* is in contact with the waste ink tank 610 and thus is easily stained. For example, if the waste ink attached to the support surface 621*a* is left without being removed, the waste ink may be thickened or solidified. With the structure in which the moving surface 623*a* of the shutter member 640 is located above the support surface 621*a*, the movement of the shutter member 640 is not easily inhibited by the thickened or solidified waste ink. Therefore, the shutter member 640 slides more stably. In addition, the detection target 660 standing on the shutter member 640 is appropriately displaced with respect to the detection member 650. Thus, it is detected with high precision whether or not the waste ink tank 610 is attached. The shutter member 640 is an example of a displaceable member.

The inkjet printers in some preferred embodiments are described above. The inkjet printers according to the present invention are not limited to any of the preferred embodiments described above. The present invention may be carried out based on the contents disclosed in this specification and the common knowledge in the art. The technologies described in the claims encompass technologies obtained by modifying or altering the preferred embodiments described above. For example, portions of the above-described preferred embodiments may be combined or replaced with another modified preferred embodiment. Still another modified preferred embodiment may be added to any of the preferred embodiments described above. A technological feature may be appropriately deleted if not described as being indispensable.

For example, in each of preferred embodiments 1 through 4 described above, the liquid collected in the waste ink tank 43, 110 or 610 is ink discharged from the ink head 22 or 93. The present invention is not limited to this. The collected liquid may be a liquid other than ink, for example, a cleaning liquid usable to clean, for example, the nozzles 22*a* of the ink head 22, a functional organic solution, a pharmaceutical drug, a resin solution or the like.

For example, in each of preferred embodiments 1 through 4 described above, a so-called shuttle printer (serial printer) 10, 60 or 90 is described. In the shuttle type printer, the ink head 22 or 93 is mounted on the carriage 19 and the carriage 19 is reciprocally moved (performs a shuttle movement) in the left-right direction X to perform printing. The present invention is not limited to this. The technology disclosed herein is similarly adoptable to a so-called line printer including a line head having a width longer than, or equal to, the width of the printing target 25*a* or 92, and performing printing in a state where the line head is secured.

The technology disclosed herein is adoptable to any of various inkjet printers. The printer 10 or the like is not limited to being used as an independent printer, and may be combined with any other device. For example, the printer 10 or the like may include a cutting head that cuts the printing target 25*a* or the like.

In preferred embodiments 1 through 4 described above, the inkjet printer is described as an example. The waste ink mechanisms 40, 40A, 100 and 600 are each adoptable to, for example, any of wide variety of devices including various production devices using the inkjet method, production devices of electronic devices, three-dimensional printing devices (so-called 3D printers), measuring devices, pharmaceutical drug absorbers, or the like.

The terms and expressions used herein are for description only and are not to be interpreted in a limited sense. These terms and expressions should be recognized as not excluding any equivalents to the elements shown and described herein and as allowing any modification encompassed in the scope of the claims. The present invention may be embodied in many various forms. This disclosure should be regarded as providing preferred embodiments of the principles of the present invention. These preferred embodiments are provided with the understanding that they are not intended to limit the present invention to the preferred embodiments described in the specification and/or shown in the drawings. The present invention is not limited to the preferred embodiments described herein. The present invention encompasses any of preferred embodiments including equivalent elements, modifications, deletions, combinations, improvements and/or alterations which can be recognized by a person of ordinary skill in the art based on the disclosure. The elements of each claim should be interpreted broadly based on the terms used in the claim, and should not be limited to any of the preferred embodiments described in this specification or used during the prosecution of the present application.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An inkjet printer, comprising:

a device main body;

a head including a nozzle that injects a liquid;

a cleaning mechanism that performs an operation of causing the liquid to be discharged from the nozzle;

a waste liquid path including an inlet into which the liquid discharged by the cleaning mechanism flows and an outlet from which the liquid is discharged;

a waste liquid tank that is detachably attached to the device main body and collects the liquid discharged from the outlet of the waste liquid path;

a displaceable member that is movably provided in the device main body, and is displaced to a first position when the waste liquid tank is attached to the device main body and is displaced to a second position when the waste liquid tank is detached from the device main body;

a liquid receiving portion that is provided on the displaceable member so as to move together with the displaceable member, and is located at a position directly below the outlet when the displaceable member is at the second position;

a detection target that is provided on the displaceable member so as to move together with the displaceable member, and is displaced to a first detection position when the displaceable member moves to the first position and is displaced to a second detection position when the displaceable member moves to the second position;

a sensor that detects a position of the detection target; and a controller that determines that the waste liquid tank is attached to the device main body when the detection target is at the first detection position and determines that the waste liquid tank is not attached to the device main body when the detection target is at the second detection position, based on a detection result of the sensor.

2. The inkjet printer according to claim 1, wherein the displaceable member includes a wall that is moved into contact with the waste liquid tank when the waste liquid tank is attached to the device main body and moves from the second position to the first position by the wall being pushed by the waste liquid tank.

3. The inkjet printer according to claim 1, wherein the device main body includes a shaft that swingably supports the displaceable member.

4. The inkjet printer according to claim 3, wherein the shaft extends in a horizontal direction; and the displaceable member is structured such that the liquid receiving portion is kept at a position directly below the outlet by a weight of the displaceable member when the waste liquid tank is not attached to the device main body.

5. The inkjet printer according to claim 1, wherein the device main body includes one support that supports both of the displaceable member and the sensor.

6. The inkjet printer according to claim 1, wherein the device main body that includes a support that supports the displaceable member such that the displaceable member is slidable with respect to the device main body, and to which the waste liquid tank is detachably attached.

7. The inkjet printer according to claim 1, further comprising a first energizing-member that includes a first end attached to the displaceable member and a second end directly or indirectly attached to the device main body, and loads the displaceable member in a direction in which the liquid receiving portion approaches the outlet; wherein the displaceable member is structured such that the liquid receiving portion is kept at a position directly below the outlet by a loading force of the first energizing member when the waste liquid tank is not attached to the device main body.

8. The inkjet printer according to claim 6, wherein the displaceable member is structured to be displaced to a third position when a predetermined amount of waste ink is collected in the waste liquid tank attached to the support;

the detection target is structured to move to a third detection position when the displaceable member moves to the third position; and the controller determines that a predetermined amount of waste liquid is collected in the waste liquid tank when the detection target is at the third detection position, based on the detection result of the sensor.

9. The inkjet printer according to claim 8, wherein the device main body includes a securing member that supports the support such that at least a portion of the support is displaceable in an up-down direction;

the inkjet printer further includes a second energizing member that includes a bottom end attached to the support and a top end directly or indirectly attached to the device main body, and loads the support upward; and the displaceable member is structured to, when the predetermined amount of waste liquid is collected in the waste liquid tank, be displaced from the first position to the third position against a loading force of the second energizing member as a result of the at least a portion of the support moving downward.

10. The inkjet printer according to claim 9, wherein the device main body includes a position adjusting member which is attached to the securing member so as to be positionally adjustable in the up-down direction with respect to the securing member and to which the top end of the second energizing member is attached; and the sensor is attached to the securing member.

11. The inkjet printer according to claim 8, wherein the cleaning mechanism includes a liquid supplier that supplies the liquid toward the waste liquid path; and the controller includes an operation interrupter that stops the liquid supplier when the displaceable member at the second position or the third position.

12. The inkjet printer according to claim 6, wherein the support includes a support surface that supports the waste liquid tank and a slide support surface that is located above the support surface and supports the displaceable member such that the displaceable member is slidable.

* * * * *